US007200355B2

(12) United States Patent
Uchiyama et al.

(10) Patent No.: US 7,200,355 B2
(45) Date of Patent: Apr. 3, 2007

(54) IMAGE HEATING APPARATUS USING ROLLER HAVING ADIABATIC LAYER OF POROUS CERAMICS

(75) Inventors: Koji Uchiyama, Numazu (JP); Toshihiko Ochiai, Tokyo (JP); Ryukichi Inoue, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 11/042,142

(22) Filed: Jan. 26, 2005

(65) Prior Publication Data

US 2005/0169679 A1 Aug. 4, 2005

(30) Foreign Application Priority Data

Jan. 30, 2004 (JP) ..... 2004-024340
Jan. 12, 2005 (JP) ..... 2005-005372

(51) Int. Cl.
*G03G 15/20* (2006.01)

(52) U.S. Cl. ..... 399/333

(58) Field of Classification Search ..... 399/328, 399/330, 333
See application file for complete search history.

(56) References Cited

U.S. PATENT DOCUMENTS 4,724,305 A * 2/1988 Iimura et al.
4,776,070 A * 10/1988 Shibata et al.
4,874,927 A * 10/1989 Shibata et al. ..... 399/330
5,191,381 A * 3/1993 Yuan ..... 399/330
5,525,775 A 6/1996 Setoriyama et al. ..... 219/216
5,543,904 A 8/1996 Kato et al. ..... 355/285
5,585,909 A * 12/1996 Behe et al.
5,649,273 A * 7/1997 Shimizu et al. ..... 399/333
6,212,349 B1 * 4/2001 Labombard
6,377,777 B1 4/2002 Kishino et al. ..... 399/329
6,502,816 B2 1/2003 Inoue et al. ..... 271/121
6,725,010 B1 * 4/2004 Parker ..... 399/330
6,944,419 B2 * 9/2005 Kawamoto et al. ..... 399/328
2001/0002954 A1 * 6/2001 Labombard
2003/0036013 A1 * 2/2003 Yamazaki et al.
2004/0192528 A1 * 9/2004 Fukase et al.

FOREIGN PATENT DOCUMENTS

JP 59-155875 9/1984
JP 2-157878 6/1990
JP 4-44075 2/1992
JP 11-149226 6/1999
JP 2002-40855 2/2002
JP 2002040855 A * 2/2002
JP 2002-221219 8/2002

* cited by examiner

*Primary Examiner*—Susan Lee
(74) *Attorney, Agent, or Firm*—Fitzpatrick, Cella, Harper & Scinto

(57) ABSTRACT

An image heating apparatus is for heating an image formed on a recording material, and has a first roller, a second roller cooperating with the first roller to form a conveying nip portion for passing the recording material therethrough, and heating means for heating the first roller from the outer peripheral surface side thereof, and each of the first roller and the second roller has an adiabatic layer formed of a porous ceramics material and an elastic layer disposed outside the adiabatic layer. Thereby, consumed power during the passing of the recording material can be suppressed.

16 Claims, 11 Drawing Sheets

IMAGE HEATING APPARATUS USING ROLLER HAVING ADIABATIC LAYER OF POROUS CERAMICS

BACKGROUND OF THE INVENTION

1. Field of the Invention

This invention relates to an image heating apparatus suitable for use as a heating and fixing apparatus carried on a copying machine or a printer using an electrophotographic recording technique or an electrostatic recording technique, and particularly to an image heating apparatus using a roller having an adiabatic layer of porous ceramics.

2. Description of Related Art

In fixing apparatuses in image forming apparatuses adopting an electrophotographic process such as copying machines, printers and facsimile apparatuses, a heating and fixing apparatus is widely, used as a fixing apparatus for fixing an unfixed toner image transferred onto a recording material such as transfer paper or OHP on the recording material. As the heating and fixing apparatus, use has been widely made of one of a heat roller type in which a pressure roller is brought into pressure contact with a heated fixing roller, and an unfixed toner image is heated and fused to thereby fix the unfixed toner image while a recording material is nipped between and conveyed by the two rollers.

FIG. 6 of he accompanying drawings shows a schematic view of a heating and fixing apparatus of the heat roller fixing type. A fixing roller 5-1 is of structure in which a heat source 5-2 such as a halogen lamp is contained in a metal core 5-1*a* made of a metal, and an elastic layer 5-1*b* formed of silicone rubber or the like and a releasing layer 5-1*c* of fluorine resin are provided on the outer peripheral surface of the metal core. A pressure roller 5-3 brought into pressure contact with the fixing roller 5-1, like the fixing roller, has an elastic layer 5-3*b* and a releasing layer 5-3*c* formed on the outer peripheral surface of a metal core 5-3*a*.

The entire fixing roller 5-1 is warmed by the heat source 5-2 contained in the interior of the fixing roller 5-1. Also, part of the energy is transmitted to the pressure roller 5-3, which is also warmed. When a transferring material 5-5 as an image recording medium bearing an unfixed toner image 5-4 thereon passes through a nip N5 between the fixing roller 5-1 and the pressure roller 5-3, the unfixed toner image 5-4 is heated and fused by the contact heat transfer between the fixing roller 5-1 and the pressure roller 5-3, and is fixed on the transferring material 5-5.

In the heating and fixing apparatus of the heat roller type, however, the heat capacity of the metal core 5-1*a* of the fixing roller 5-1 is great and therefore, the time until the nip N5 is raised to a predetermined fixing temperature becomes long. Nowadays when energy saving is demanded, there is required a fixing apparatus which is good in efficiency and quick in rising. FIG. 7 of the accompanying drawings shows the consumed power waveform of the heating and fixing apparatus of the heat roller fixing type with time as the axis of abscissas and power as the axis of ordinates. The shown power waveform A is the result of the measurement of power consumed by the heating and fixing apparatus from the moment when the power supply switch of a printer has been closed until the termination of the continuous printing of 200 sheets. According to a graph line in FIG. 7, the consumed power has lowered to the order of 500 W after power of 700 W has been supplied for about 180 sec. First, the section in which constant power of 700 W is consumed is the section of rising of the fixing apparatus. Power is consumed at full power in order to heat the fixing apparatus to a predetermined fixing temperature, and the power waveform exhibits constant power. When the fixing apparatus is raised to the predetermined fixing temperature, the conveyance of paper is started and printing is started. This start of the printing is indicated by the timing at which the consumed power indicated by the power waveform A changes from 700 W to 500 W. This is because control (temperature control) for maintaining a predetermined temperature has begun. During the printing, the power is consumed to make up for chiefly the radiation of the fixing apparatus, heat taken away by the printing paper when it passes through the fixing apparatus, and heat given to a toner, and usually, power consumed during the printing is low as compared with power supplied at full power during the rising of the fixing apparatus. Accordingly, it is possible to read the rising time of the fixing apparatus from the waveform of the consumed power.

In the description of the present invention, consideration about the rising time will be described with some power waveforms shown, and on the basis of the above-described mechanism, discussion will be made with the time required until a point at which the power consumed at full power changes and becomes low as the rising time.

The rising time is shortened, whereby the first print-out time can be shortened, and this in turn leads to a reduction in the consumed power. To shorten the rising time, the heat capacity of the fixing roller can be made small, and as one of countermeasures, there has been studied a method of making the wall thickness of the metal core of the fixing roller small to thereby make the heat capacity thereof small. However, when the wall thickness of the fixing roller is made small, the mechanical strength of the roller becomes weak and the fixing roller becomes curved at the nip portion whereat it contacts with the pressure roller and the contact pressure of the central portion thereof becomes weak, and the nip is decreased and the fixing intensity is reduced. In order to prevent this inconvenience, various methods of reinforcing the fixing roller have been proposed.

For example, Japanese Patent Application Laid-open No. S59-155875 proposes a fixing roller having radial ribs provided horizontally with respect to the axis of the roller on the inner surface thereof. Also, Japanese Patent Application Laid-open No. H11-149226 proposes a fixing roller having internal structure in which radial ribs are inclined and extended with respect to the axis of the roller.

FIG. 8 of the accompanying drawings shows a schematic view of the fixing roller having radial ribs provided horizontally with respect to the axis of the roller on the inner surface thereof. An elastic layer 6-2 formed of silicone rubber or the like and a releasing layer 6-3 formed of fluorine resin are provided on the outer peripheral surface of a metal core 6-1 provided with the ribs. The metal core 6-1 is consolidated by the ribs on the inner surface, and can keep its strength even if the wall thickness thereof is made small.

By these propositions, the wall thickness of the fixing roller is made small and the shortening of the rising time of the fixing apparatus is done while the strength of the roller is kept and the fixing intensity is kept.

There has also been proposed a heat roller fixing apparatus of an external heating type in which a heat source so far contained in the interior of a fixing roller is disposed externally of the roller.

Japanese Patent Application Laid-open No. 2002-40855 proposes a heat roller fixing apparatus having an external heating apparatus and using a material having an adiabatic property for a pressure roller. Japanese Patent Application Laid-open No. 2002-221219 proposes a heat roller fixing apparatus having an external heating apparatus and using a material having an adiabatic property for a fixing roller.

In the respective constructions, it becomes possible to quickly warm the surface of the fixing roller by the external heating apparatus, and it becomes possible to shorten the rising time of the fixing apparatus.

Also, in these propositions, one of the pressure roller and the fixing roller is formed of a material excellent in adiabatic property, and design is made such that the rising time can be further shortened.

In the construction of Japanese Patent Application Laid-open No. 2002-40855, the pressure roller is formed of a material of high hardness excellent in adiabatic property, and the fixing roller opposed thereto is of structure in which an elastic layer is provided on a metal core. As the material excellent in adiabatic property, use is made of porous ceramics of high hardness, and even if pressure is applied thereto, pores are not crushed, but it is possible to maintain the adiabatic property. The fixing roller opposed to the pressure roller is also provided with an elastic layer to thereby secure a fixing nip. In this construction, design is made such that during the rising, it is difficult for the heat of the fixing roller to be taken away by the adiabatic pressure roller and a rising speed is heightened.

On the other hand, in the construction of Japanese Patent Application Laid-open No. 2002-221219, the fixing roller is formed of a highly adiabatic material, and the pressure roller opposed thereto is of structure in which an elastic layer is provided on a metal core. As the material excellent in adiabatic property, use is made of porous ceramics of high hardness, and even if pressure is applied thereto, pores are not crushed, but it is possible to maintain the adiabatic property. Also, the pressure roller opposed to the fixing roller is provided with an elastic layer to thereby secure a fixing nip. In this construction, the effect that only the surface layer of the adiabatic fixing roller can be quickly raised in temperature heightens, and design is made such that the rising speed is heightened.

FIG. 9 of the accompanying drawings shows a schematic view of a heating and fixing apparatus which is provided with an external heating apparatus in which one roller is formed of a material excellent in adiabatic property. A fixing roller 7-1 is of structure in which an elastic layer 7-1*b* and a releasing layer 7-1*c* are provided on the outer peripheral surface of a metal core 7-1*a* made of a metal. A pressure roller 7-2 brought into pressure contact with the fixing roller 7-1 has an adiabatic material layer 7-2*b* formed of porous ceramics or the like and a releasing layer 7-2*c* formed externally of a metal core 7-2*a*. Heating means 7-3 having structure in which a heater 7-3*b* is provided in a roller 7-3*a* made of a metal abuts against the external portion of the fixing roller 7-1, and the fixing roller 7-1 is heated by this heating means 7-3, and the fixing roller performs a fixing operation after the surface temperature thereof has reached a fixing temperature. During the rising of the fixing apparatus, only the vicinity of the surface of the fixing roller 7-1 is warmed and therefore, it is possible to quickly raise the surface temperature of the fixing roller 7-1.

Further, the pressure roller 7-2 is heat-insulated and therefore, during the rising, it is difficult for the surface heat of the fixing roller 7-1 to be taken away by the pressure roller 7-2, and it is possible to raise the surface temperature of the fixing roller more efficiently in a case where for example, the both rollers are constituted by elastic layers formed of rubber or the like.

FIG. 10 of the accompanying drawings shows a graph of power waveforms in a conventional heat roller fixing type, a heating roller fixing type using a fixing roller on the inner surface of which radial ribs are provided horizontally with respect to the axis of the roller, and a heating roller fixing type provided with an external heating apparatus, with time as the axis of abscissas and power as the axis of ordinates. These power waveforms have been measured under a process condition in which the fixing intensity of an unfixed toner image onto a recording material becomes the same at a conveying speed of 200 mm/sec for the recording material.

The fixing intensity represents with how much force an unfixed image fixed by the fixing apparatus is fixed on the recording material, and is represented by a density reduction rate (unit: %). Description will now be made of a method of measuring the density reduction rate.

As the unfixed image, use is made of black and halftone (gray) images of 5 mm square disposed at nine locations on letter-size paper.

The halftone pattern of the unfixed image is a pattern in which pixel density of 600 dpi was formed by a matrix of 3×3 and this was formed in a staggered shape with one dot one space.

The density of the halftone of the image after passed through the fixing apparatus is measured by a density measuring machine (produced by Macbeth Co., Inc.), whereafter the image is rubbed by a rubbing test machine for exclusive use, and the density of the halftone after rubbing is again measured, and the reduction rate of the density is calculated.

The rubbing test machine is of structure in which metallic weight of 200 g is placed on a stand for fixing paper thereon by electricity in accordance with the black and halftone patterns of 5 mm square disposed at nine locations on the paper. Silbon C paper (produced by Ozu Corporation) is sandwiched between the paper and the weight. The stand for fixing the paper thereon is adapted to be reciprocally movable in the longitudinal direction of the paper, and at this time, the image is rubbed by the Silbon C paper and is broken. In the present embodiment, the image was rubbed by the stand reciprocally moved five times.

This reduction rate of the density is calculated with respect to all of the halftone images at nine locations on the letter-size paper, to thereby calculate the average value, and is used as an index representative of the fixing intensity under that condition.

In the measurement at this time, the process condition in each fixing process was defined so that in a laboratory kept at humidity of 50%, the density reduction rate in rough paper (Fox River Bond produced by Fox River Paper Co.) of basis weight of 90 g as a recording material might be 10%.

If under the above-described environment, the density reduction rate is 10%, it is usually such a level that even if the toner is strongly rubbed by fingers, the toner will not come off from the paper, and is at a level which can be sufficiently fit for practical use.

A power waveform A in the heating roller fixing type in FIG. 10 is the same as that plotted in FIG. 9.

During the rising of the fixing apparatus, power of 700 W is consumed, whereafter temperature control is started and consumed power lowers to 500 W. The time from the start of electrical energization until the consumed power lowers is 180 sec., and the time required for the rising can be 180 sec.

Likewise observing the graph, the rising time is greatly shortened in the heating roller fixing type using a fixing roller provided with ribs on the inner surface thereof and made small in the wall thickness thereof, and the heating roller fixing type provided with an external heating apparatus.

In FIG. 10, a power waveform indicated by B is a power waveform in the heating roller fixing type using a fixing roller provided with ribs horizontal with respect to the axis of the roller. According to this, the time until the power so far consumed by 700 W lowers to 500 W is about 60 sec. A power waveform indicated by C is a power waveform in the heating roller fixing type provided with an external heating apparatus, and in this fixing type, a change is seen in the power in 40 sec. Accordingly, in the heating roller type using the fixing roller provided with the ribs and made small in the wall thickness thereof, the rising time can be considered to be 60 sec., and in the heating roller type provided with the external heating apparatus, the rising time can be considered to be 40 sec., and it is seen that as compared with the conventional heating roller type, both of these greatly shorten the rising time.

The rising time has been shortened because of the curtailment of the heat capacity by the smaller wall thickness of the roller, and a construction in which the surface of the fixing roller is quickly warmed by the external heating apparatus and further, it is difficult for the heat to be taken away from the surface of the warmed fixing roller by the pressure roller.

By the curtailment of the heat capacity and an improvement in the heating method, the shortening of the rising time has been advanced also in the heat roller fixing type.

An improvement in the heating and fixing apparatus of the heating roller fixing type has been advanced, while on the other hand, there has been proposed an example of a heating and fixing apparatus using a method which eliminates the necessity of supplying power to the heating and fixing apparatus during standby and which minimizes consumed power, and more particularly a film heating type in which a toner image on a recording material is fixed through thin film of small heat capacity interposed between a heater portion and a pressure roller (for example, Japanese Patent Application Laid-open No. H2-157878 or Japanese Patent Application Laid-open No. H4-44075).

FIG. 11 of the accompanying drawings shows a schematic view of the fixing apparatus adopting the film heating type. This fixing apparatus comprises a ceramic heater 9-1 as a heating member, a stay 9-2 which is a supporting member adiabatically supporting the heater 9-1, fixing film 9-3 of a thin-walled cylindrical shape formed of a heat-resistant resin material and twined on the stay 9-2 supporting the heater 9-1, a pressure roller 9-4 brought into pressure contact with the heater 9-1 with the fixing film 9-3 interposed therebetween to thereby form a nip portion N9, etc.

The rotative driving of the pressure roller 9-4 is done, and along therewith, the fixing film 9-3 is driven to rotate, the heater 9-1 is electrically energized and in a state in which it is temperature-controlled to a predetermined temperature, a recording material 9-6 bearing an unfixed toner image 9-5 thereon is conveyed to the nip portion N9, and is nipped by and conveyed through the nip portion N9 together with the fixing film 9-3 to thereby impart the heat of the heater 9-1 to the recording material 9-6 through the fixing film 9-3 and fix the unfixed toner image 9-5.

The fixing film 9-3 is thin and small in heat capacity and good in heat responsiveness and therefore, the time required from after the heater 9-1 is electrically energized until it is temperature-controlled to the predetermined temperature is short, and energy saving accompanying this is realized.

FIG. 12 of the accompanying drawings shows a result obtained by plotting the waveform of power consumed in each heating type by the heating and fixing apparatus from a moment when the power supply switch of a printer has been closed until the termination of the continuous printing of 200 sheets, with time as the axis of abscissas and power as the axis of ordinates. These power waveforms have been measured under a process condition in which at a conveying speed of 200 mm/sec. for the recording material, the fixing intensity of the unfixed toner image onto the recording material becomes the same. Power waveforms indicated by A to C are by three fixing types, i.e., the heat roller type and the heating roller types by the fixing roller provided with the ribs on the inner surface thereof, and these are the same as the plots shown in FIGS. 7 and 10. In FIG. 12, according to the waveform A, in the heat roller type, when power of 700 W is supplied to the heater, about 180 sec. is required until the fixing apparatus completely rises. According to the waveform B, in the heating roller type using the fixing roller provided with the ribs on the inner surface thereof to thereby make the wall thickness thereof, the heat capacity of the roller was reduced and therefore, the rising time of the fixing apparatus is shortened to 60 sec. According to the waveform C, the external heating apparatus is provided and the surface temperature of the fixing roller is quickly raised, whereby the rising time can be shortened, and the rising time is shortened to 40 sec. In the film heating type represented by D, a member of smaller heat capacity is used. The power consumed by 700 W at the early stage of the start of electrical energization immediately lowers to 500 W, and the time hitherto required is about 10 sec. Accordingly, the time required for rising is 10 sec. and as compared with the other heating and fixing types, very quick rising of the fixing apparatus is realized.

As described above, the time until the entire fixing apparatus is warmed and temperature control is started has been shortened and energy saving has been done.

In the heat roller fixing type, by a construction in which the curtailment of the heat capacity is done by the thin-walled roller provided with the rib structure on the inner surface thereof and the rising time becomes shorter, and the vicinity of the surface of the fixing roller is quickly warmed by the external heating apparatus and the adiabatic property of the pressure roller opposed to the fixing roller is enhanced to thereby make it difficult for the heat to be taken away, the shortening of the rising time has been advanced. Also, in the film heating type, film of small heat capacity is adopted, whereby the further shortening of the rising time has been done.

However, as shown also in FIG. 12, in any of the heating roller fixing type, the heating roller fixing type using the thin-walled fixing roller, the heating roller type having the external heating apparatus and the film heating type, there is no great change in the consumed power during the passing of the recording material, and substantially equal power is consumed. As a factor which fixes the toner, the effect by heat transfer is dominant, and during the passing of paper, the movement of heat is effected through the nip between the upper and lower rollers. Also, during the passing of paper, fixing depending on heat transfer is dominant and therefore, in any fixing type, the average consumed power during the printing after the start of temperature control has been substantially equal (about 500 W).

In the heating and fixing type, heat is imparted to an unfixed toner image on a recording material in the fixing nip by contact heat transfer to thereby effect fixing, and during the passage of the recording material, much of the heat in the nip is taken away by the recording material.

To obtain the same fixing intensity by the use of the same toner and at the same recording material conveying speed, in any type, it is necessary to supply the same amount of heat into the nip, and the amount of heat taken away during the passage of the recording material also becomes substantially equal.

Accordingly, the power consumed to make up for it becomes substantially equal in any type.

SUMMARY OF THE INVENTION

The present invention has been made in view of the above-noted problems and an object thereof is to provide an image heating apparatus which can suppress consumed power during the passing of a recording material.

Another object of the present invention is to provide an image heating apparatus in which a time required for the rising of the apparatus is short and which can suppress consumed power during the passing of a recording material.

Still another object of the present invention is to provide an image heating apparatus for heating an image formed on a recording material, the heating apparatus comprising a first roller, a second roller cooperating with the first roller to form a conveying nip portion for passing the recording material therethrough, and heating means for heating the first roller from the outer peripheral surface side thereof, wherein each of the first roller and the second roller has an adiabatic layer formed of a porous ceramics material, and an elastic layer disposed outside the adiabatic layer.

Further objects of the present invention will become apparent from the following detailed description when read with reference to the accompanying drawings.

DESCRIPTION OF THE PREFERRED EMBODIMENTS

First Embodiment (1) Example of an Image Forming Apparatus

Figure 1:
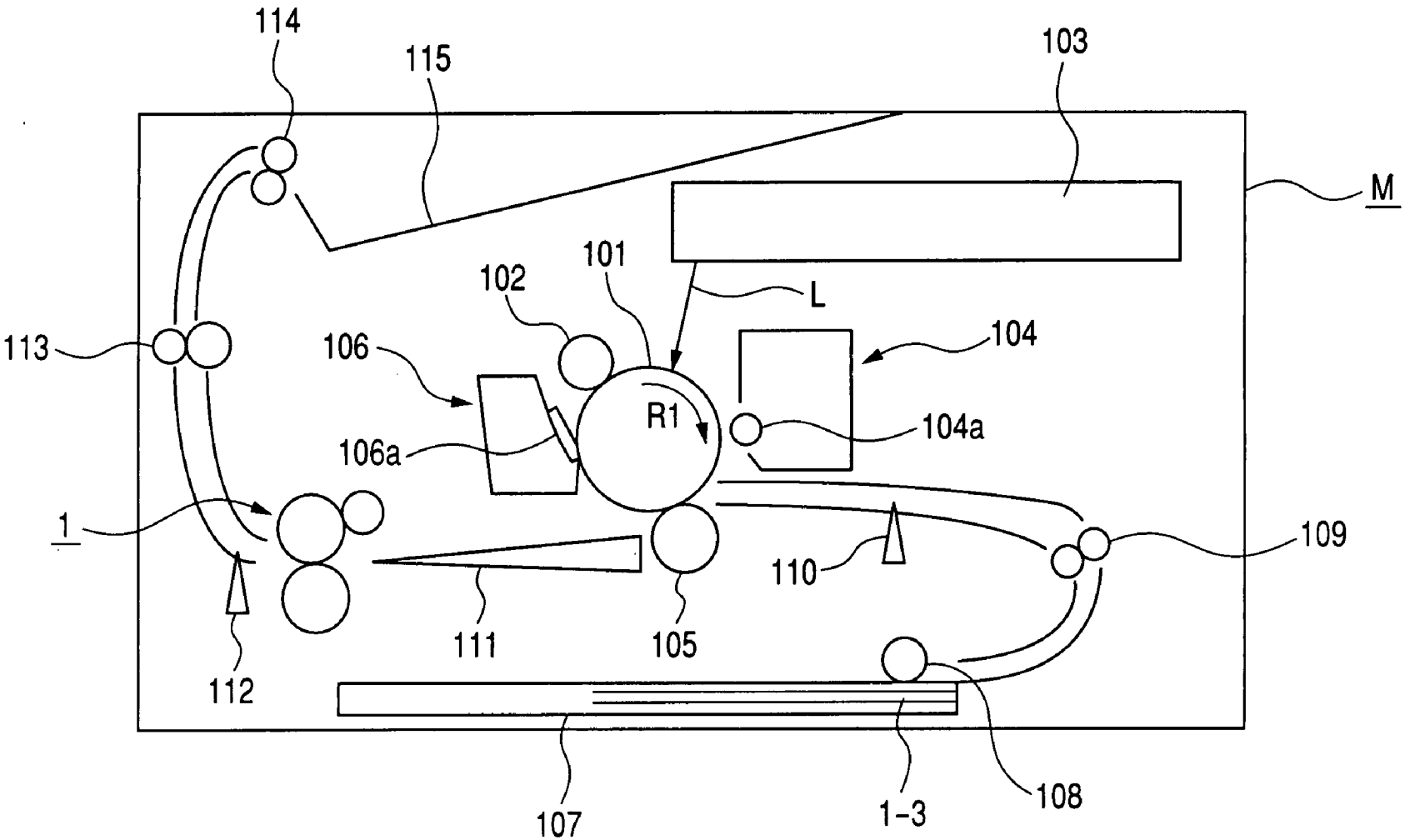
FIG. 1 is a schematic view of an example of an image forming apparatus carrying the image heating and fixing apparatus of the present invention thereon.

FIG. 1 shows an image forming apparatus provided with a fixing apparatus according to the present invention. The image forming apparatus in this example is a laser beam printer utilizing a transfer type electrophotographic process. The image forming apparatus in the present example is provided with a drum-shaped electrophotographic photosensitive member (hereinafter referred to as the photosensitive drum) 101 as an image bearing member. The photosensitive drum 101 is rotatably supported by an apparatus main body M, and is rotatively driven at a predetermined process speed in the direction of arrow R1 by driving means (not shown). A charging roller (charging apparatus) 102, exposing means 103, a developing apparatus 104, a transferring roller (transferring apparatus) 105 and a cleaning apparatus 106 are disposed around the photosensitive drum 101 substantially in the named order along the direction of rotation thereof. Also, a sheet feeding cassette 107 containing therein recording materials (transferring materials) 1-4 as sheet-like image recording mediums such as paper is disposed in the lower portion of the apparatus main body M, and a sheet feeding roller 108, conveying rollers 109, a top sensor 110, a conveying guide 111, a fixing apparatus 1 according to the present invention, a sheet discharge sensor 112, conveying rollers 113, sheet discharging rollers 114 and a sheet discharging tray 115 are disposed along the conveying route of the recording material 1-4 in the named order from the upstream side.

The photosensitive drum 101 rotatively driven in the direction of arrow R1 by the driving means is uniformly charged to a predetermined polarity and predetermined potential by the charging roller 102. The photosensitive drum 101 after charged has its surface subjected to image exposure L based on image information by the exposing means 103 such as a laser optical system, and charges in the exposed portion thereof are eliminated and an electrostatic latent image is formed thereon. The electrostatic latent image is developed by the developing apparatus 104. The developing apparatus 104 has a developing roller 104*a*, and a developing bias is applied to this developing roller 104*a* to thereby cause a toner to adhere to the electrostatic latent image on the photosensitive drum 101, and develop (visualize) the latent image as a toner image. The toner image is transferred to the recording material 1-4 such as paper by the transferring roller 105.

The recording material 1-4 is contained in the sheet feeding cassette 107, is fed by the sheet feeding roller 108, is conveyed by the conveying rollers 108, and is conveyed to the transfer nip portion between the photosensitive drum 101 and the transferring roller 105 through the top sensor 110. At this time, the recording material 1-4 has its leading edge detected by the top sensor 110, and is synchronized with the toner image on the photosensitive drum 101. A transferring bias is applied to the transferring roller 105, whereby the toner image on the photosensitive drum 101 is transferred to a predetermined position on the recording material 1-4.

The recording material 1-4 bearing the unfixed toner image on the surface thereof by the transfer is conveyed to the fixing apparatus 1 along the conveying guide 111, and there the unfixed toner image is heated and pressurized, whereby it is fixed on the surface of the recording material 1-4.

After the fixing of the toner image, the recording material 1-4 is conveyed by the conveying rollers 113, and is discharged onto the sheet discharging tray 115 on the upper surface of the apparatus main body M by the sheet discharging rollers 114.

On the other hand, the photosensitive drum 101 after the transfer of the toner image to the recording material 1-4 has the toner not transferred to the recording material 1-4 but residual on its surface removed by the cleaning blade 106*a* of the cleaning apparatus 106, and is used for the next image forming.

The above-described operation is repeated, whereby image forming can be effected one after another.

(2) Fixing Apparatus (Image Heating Apparatus) 1

Figure 2:
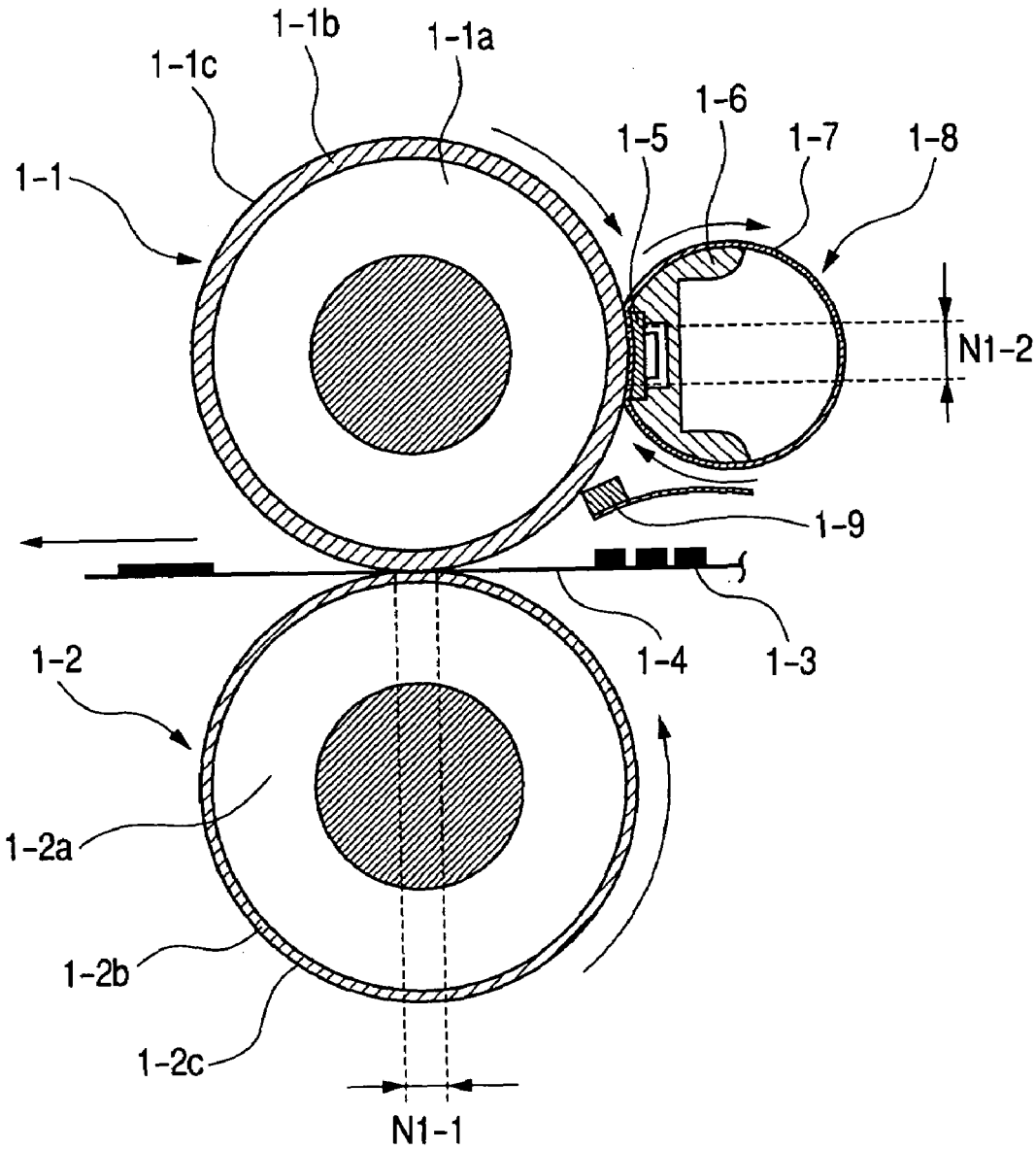
FIG. 2 is a conceptual view (first embodiment) of the image heating and fixing apparatus of the present invention.

FIG. 2 shows the structure of the fixing apparatus 1. The fixing apparatus 1 of the present embodiment is a fixing apparatus of a fixing member external heating type having a fixing roller (first roller) 1-1 and a pressure roller (second roller) 1-2 as first and second rollers (fixing members) brought into pressure contact with each other to thereby form a nip portion (conveying nip portion) N1-1, heating the fixing roller 1-1 by external heating means (heating means), and nipping and conveying the recording material 1-4 bearing the toner image 1-3 thereon by the nip portion N1-1 to thereby fix the toner image on the recording material 1-4.

The fixing roller 1-1 is of a construction in which a roller base 1-1*a* is porous ceramics (adiabatic layer) having an outer diameter of 40 mm and an inner diameter of 20 mm, and a silicone rubber layer 1-1*b* having a thickness of about 1 mm as an elastic material layer (elastic layer) is provided on the outer peripheral surface of the roller base 1-1*a*, and further a fluorine resin layer 1-1*c* as a releasing layer is provided on the outer peripheral surface thereof with a thickness of 30 μm.

The pressure roller 1-2 is of a construction in which a roller base 1-2*a* is porous ceramics (adiabatic layer) having an outer diameter of 40 mm and an inner diameter of 20 mm, and a silicone rubber layer 1-2*b* having a thickness of about 0.3 mm as an elastic material layer (elastic layer) is provided on the outer peripheral surface of the roller base 1-2*a*, and further a fluorine resin layer 1-2*c* as a releasing layer is provided on the outer peripheral surface thereof with a thickness of 30 μm.

The porous ceramics used in the present embodiment are burned substances of mixing materials of an inorganic binder and a heat-resistant inorganic material. The internal porosity of a porous ceramic is 30% to 90% preferably 50% to 90%, its bulk density is 0.2–1.0 g/cm$^2$ and preferably 0.3–0.7 g/cm$^2$ and its heat conductivity is 0.1–0.2 W/mK.

The inorganic binder is a material to bind inorganic materials in the process of burning porous ceramics. For example, a glass frit, a colloidal silica, an alumina sol, a silica sol, a silicate of soda, a titania sol, a silicate of lithium or a liquid glass is an example of an inorganic binder.

An alumina, a silica, a zirconia, a titania, a zeolite, a silicon carbide, a potassium titanate or a calcium carbonate is an example of a heat-resistant inorganic material.

The pressure roller 1-2 is disposed under and in parallel to the fixing roller 1-1, and is brought into pressure contact with the latter with predetermined pressure to thereby form the nip portion N1-1.

The fixing roller 1-1 is rotatively driven in the clockwise direction of arrow by a driving system, not shown, and the pressure roller 1-2 is driven to rotate in the direction of rotation of the fixing roller 1-1, and when the recording material 1-4 bearing the unfixed toner image 1-3 thereon is introduced into the nip portion N1-1, the pressure roller 1-2 cooperates with the fixing roller 1-1 to nip and convey the recording material 1-4. In the present embodiment, the conveying speed of the recording material 1-4 is 200 mm/sec.

In the present embodiment, the external heating means 1-8 is means for externally heating the fixing roller 1-1, and uses a ceramic heater unit of the known film heating type. That is, this external heating means 1-8 comprises a ceramic heater 1-5 as a heating member, a stay 1-6 which is a supporting member adiabatically supporting this heater, and film (flexible sleeve 1-7 of a thin walled cylindrical shape rotated while the inner peripheral surface thereof contacts with the heater 1-5 and the outer peripheral surface thereof contacts with the fixing roller. This external heating means 1-8 is arranged so that the heater 1-5 side thereof may be parallel to the fixing roller 1-1, and is brought into pressure contact with the fixing roller 1-1 with total pressure of 10 kg (98N). At this time, a nip portion (heating nip portion) N1-2 is formed by the fixing roller 1-1 and the heater 1-5. The width of the nip portion N1-2 at this time was about 6 mm. The fixing roller 1-1 is rotatively driven, and along therewith, the film 1-7 of the external heating means 1-8 becomes driven to rotate while frictionally sliding with respect to the heater 1-5 and the stay 1-6. Thereafter, the heater 1-5 is electrically energized and generates heat, and the surface of the fixing roller 1-1 is heated. Temperature detecting means 1-9, and specifically a negative temperature coefficient (NTC) thermistor abuts against on the periphery of the fixing roller 1-1 between the external heating means 1-8 and the nip portion N1-1, and is designed to monitor the surface temperature of the fixing roller 1-1. Fixing roller temperature detection information is inputted to a control circuit, not shown, by this temperature detecting means 1-9. The control circuit controls power supply to the heater 1-5 of the external heating means 1-8 so that the detected temperature of the fixing roller inputted from the temperature detecting means 1-9 may be maintained at a predetermined temperature (fixing temperature). Thereby, the surface temperature of the fixing roller 1-1 is controlled to a predetermined temperature.

In the present embodiment, a load applied to between the fixing roller 1-1 and the pressure roller 1-2 was changed at intervals of 10 kg (98N) to 10 kg –50 kg (98N–490N) to thereby provide Embodiments 1-1 to 1-5.

In Embodiments 1-1 to 1-5, such a fixing temperature that the density reduction rate in rough paper (Fox River Bond produced by Fox River Paper Co., Inc.) of basis weight 90 g becomes 10% was measured in a laboratory kept at a room temperature of 23° C. and humidity of 50%, and the consumed power at that controlled temperature from the ON of the power supply switch of the fixing apparatus till the termination of the continuous printing of 200 sheets was measured. The description of the density reduction rate as the index of the fixing intensity has been made previously and therefore need not be made here. Also, the widths of the nip portion N1-1 between the fixing roller 1-1 and the pressure roller 1-2 at respective loads were compared with one another. The result of the measurement is summed up in Table 1 below.

TABLE 1

| | Load (kg) | Fixing temperature (° C.) | Consumed Power (W) during Printing | Nip Width (mm) |
|---|---|---|---|---|
| Embodiment 1-1 | 10 | 185 | 500 | 2.5 |
| Embodiment 1-2 | 20 | 170 | 450 | 2.8 |
| Embodiment 1-3 | 30 | 160 | 410 | 2.9 |
| Embodiment 1-4 | 40 | 155 | 380 | 2.9 |
| Embodiment 1-5 | 50 | 150 | 350 | 3.0 |

In the respective Embodiments 1-1 to 1-5, the nip width did not substantially changed. This is because the thin elastic layer of a thickness 1 mm (the total thickness of the elastic layer including the elastic layer of the pressure roller is as small as 1.3 mm) (of the fixing roller) is compressed and the influence of the hardness of the porous ceramics layer under the elastic layer appears. As the load becomes greater from Embodiment 1-1 to Embodiment 1-5, the fixing temperature at which the halftone density reduction rate achieves 10% lowers. When in Embodiment 1-1, the load was 10 kg, the fixing temperature was 185° C., but in Embodiment 1-5, the load was 50 kg and the fixing temperature lowered to 150° C. This is because due to a construction in which even if the load is increased, the nip width does not increase, the pressure in the nip heightened. When the pressure heightens the toner comes to be crushed more flatly between the roller and the recording material, and the area of contact between the roller and the recording material becomes greater. In this state, the toner is more improved in heat conductivity than usual and therefore, by the imparting of a small amount of heat, the heat is well transferred to the entire toner, and it becomes possible to fuse the toner. That is, in the construction of the present embodiment, the heat transfer dependency of a factor which fixes the toner becomes low and the pressure dependency heightens. Accordingly, the amount of heat consumed during fixing becomes capable of being suppressed low, and the fixing temperature lowers. With the lowering of the fixing temperature, the power consumed during printing is also reduced. In Embodiment 1-1, the power consumed during printing at a fixing temperature of 185° C. was 500 W, but in Embodiment 1-5, the fixing temperature lowered to 150° C. and the power consumed during printing was also reduced to 350 W.

Figure 13:
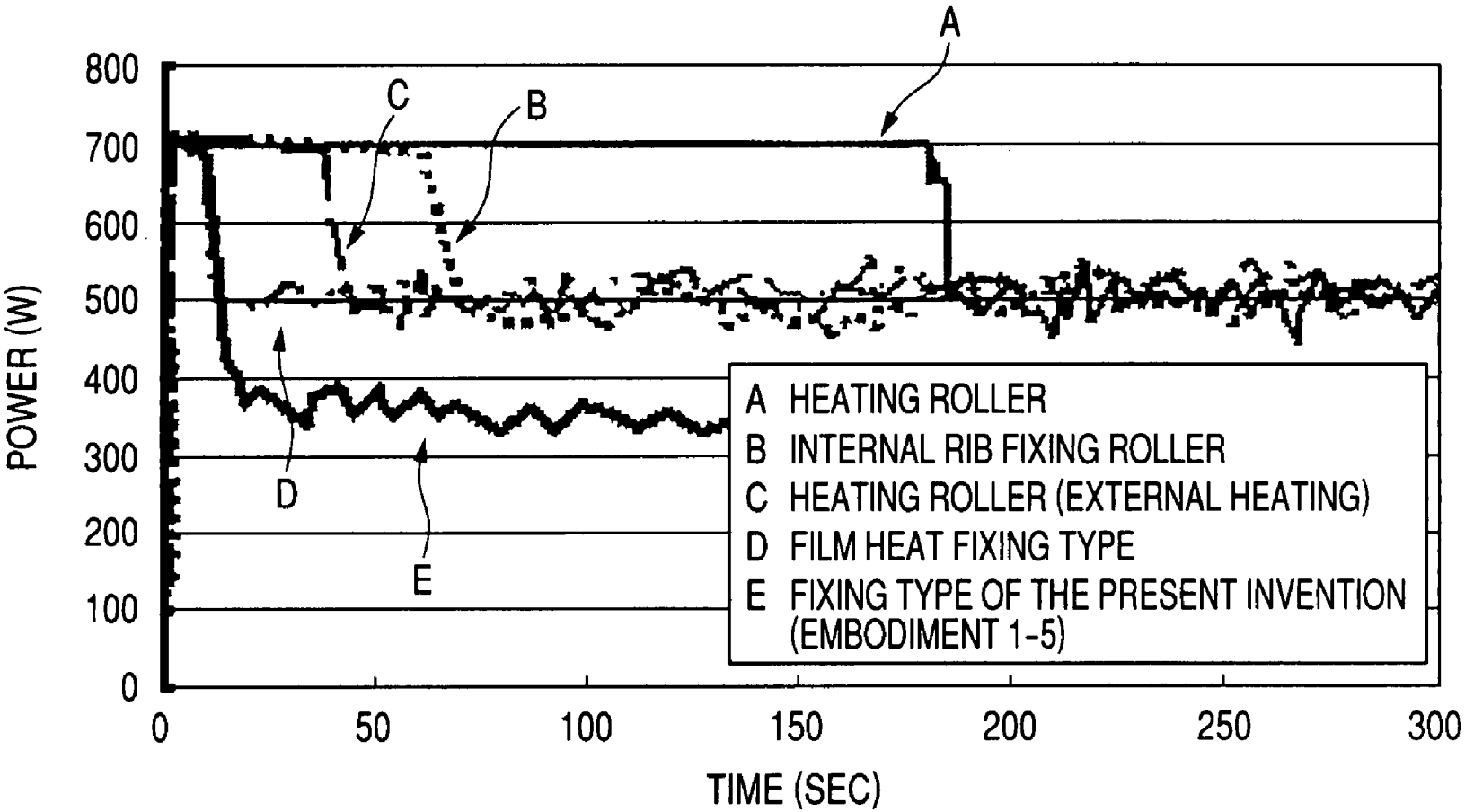
FIG. 13 is a graph of consumed power waveforms in various conventional examples and the heating and fixing type of the present invention.

FIG. 13 shows a result obtained by plotting the waveform of power consumed by the heating and fixing apparatus from a moment when the power supply switch of the printer has been closed till the termination of the continuous printing of 200 sheets in the present embodiment with time as the axis of abscissas and power as the axis of ordinates. As the representative of the present embodiment, the power waveform of Embodiment 1-5 is indicated by a line E in FIG. 13. Also, as comparative examples, the results of measurement in heating and fixing apparatuses of the conventional heating roller fixing type, the heating roller fixing type using a thin-walled fixing roller, and the film heating type are indicated by waveforms A to D. These power waveforms were measured under a process condition in which at the conveying speed of 200 mm/sec. of the recording material, the fixing intensity of the unfixed toner image on the recording material becomes the same. The fixing intensity has already been described and therefore need not be described here.

Figure 12:
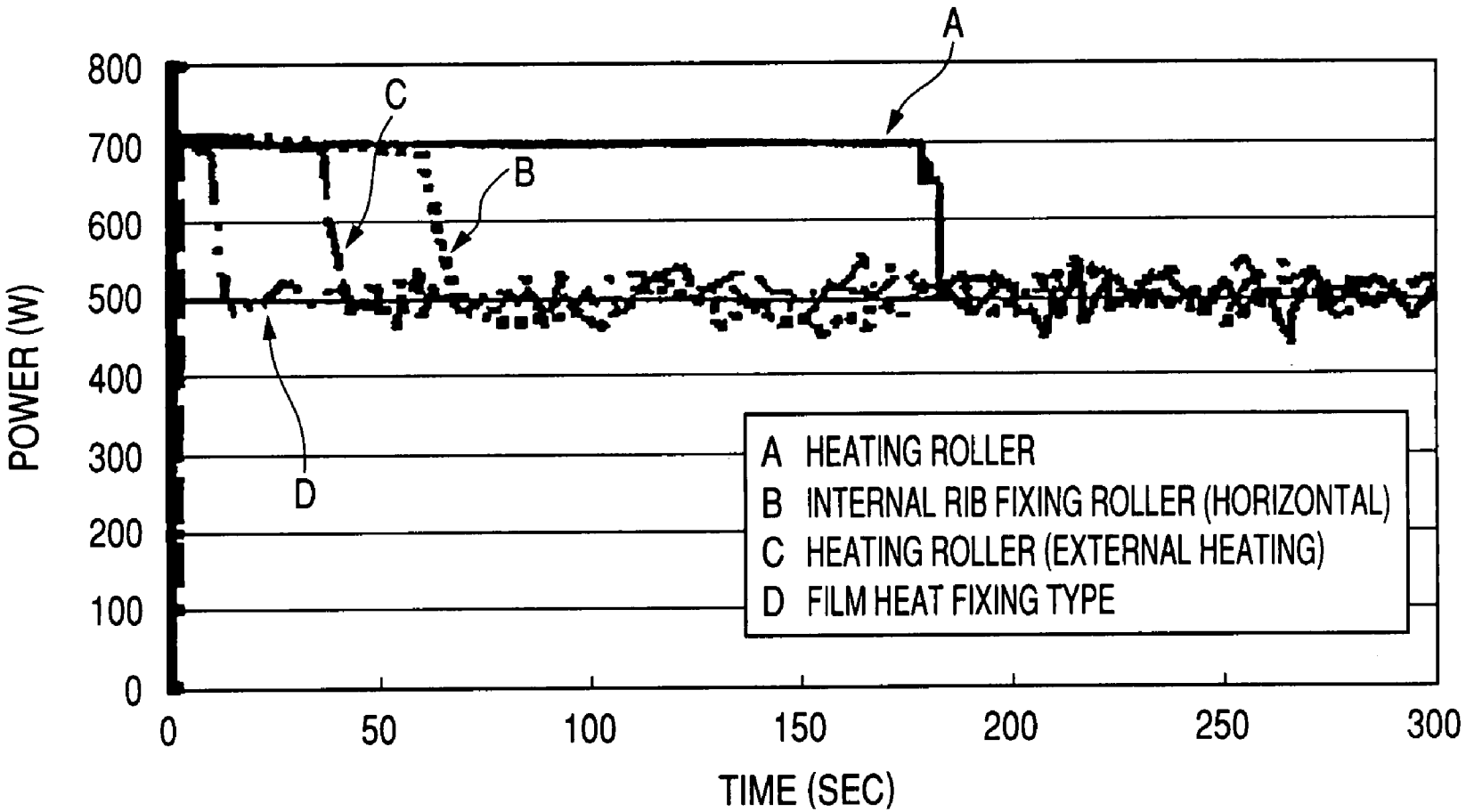
FIG. 12 is a graph of consumed power waveforms in various conventional heating and fixing types.

The power waveforms A to D in FIG. 13 are similar to those plotted in FIG. 12. In FIG. 13, according to the waveform A, in the heating roller type, when power of 700 W is supplied to the heater, about 180 seconds is required until the fixing apparatus rises completely. According to the waveform B, in the heating roller type using a fixing roller thin-walled by providing the ribs on the inner surface thereof, the heat capacity of the roller was reduced and therefore, the rising time of the fixing apparatus is shortened to 60 sec. According to the waveform C, the external heating apparatus 1-8 is provided and the surface temperature of the fixing roller is quickly raised, whereby the rising time can be shortened, and the rising time is shortened to 40 sec. In the film heating type represented by D, a member of smaller heat capacity is used. The power consumed by 700 W at the initial stage of the start of electrical energization lowers immediately to 500 W, and the time hitherto required is about 10 sec. Accordingly, the time required for rising is 10 sec. and as compared with the other heating and fixing types, very quick rising of the fixing apparatus is realized. The power waveform indicated by E is a power waveform in the present Embodiment 1-5. The power of 700 W consumed at the initial stage of the start of electrical energization changes 10 sec. after, whereafter it lowers to about 350 W.

Here, description will be made of the behavior of the power waveform in the present Embodiment 1-5. In the construction of the present embodiment, the fixing roller is heat-insulated and therefore, an amount of heat necessary for the elastic material layer of the fixing roller can be accumulated to thereby quickly heat the surface of the fixing roller to a predetermined temperature. At this time, the transfer of the heat is suppressed to the utmost because the portion under the elastic material layer is constituted by an adiabatic layer, and the heat trapped by the surface of the roller is carried to the nip portion N1-1. The width of the nip portion N1-1 formed by the fixing roller 1-1 and the pressure roller 1-2 in the direction of movement of the recording material is narrow and the pressure roller 1-2 also uses an adiabatic material for the base thereof, and this leads to a construction in which it is difficult for the heat from the elastic layer 1-1*b* of the fixing roller 1-1 to be transferred to the pressure roller 1-2.

Therefore, quick rising is possible and a rising time of 10 sec. equal to that in the fixing process of the film heating type shown in the power waveform D was exhibited. This is because due to a construction in which the nip width does not increase even if the load increases, the pressure in the nip has heightened. Also, in the present Embodiment 1-5, a load of 50 kg (490N) is applied to the nip portion N1-1 having a width of 3 mm, and the pressure in the nip is very high.

In the conventional fixing type (including the heating roller fixing type and the film heating type shown in FIG. 12), the fixing nip width is usually formed to 6 mm or greater. This is attributable to the fact that the factor which fixes the toner differs from that in the present embodiment. In the conventional fixing type, the fixing of the toner by heat transfer is dominant and therefore, design is made such that the nip width is secured widely and the toner can absorb as much heat as possible.

In the present embodiment, a high load is designed to be applied to a narrow nip, and design is made such that as the factor of the fixing of the toner, pressure becomes dominant. When the pressure heightens, the toner comes to be crushed more flatly between the rollers and the recording material, and the area of contact between the rollers and the recording material becomes large. In this state, the toner is more improved in heat conductivity than usual and therefore, by the imparting of a small amount of heat, the heat is well transferred to the entire toner, and it becomes possible to fuse the toner. Accordingly, the amount of heat consumed during fixing becomes capable of being suppressed low, and the fixing temperature lowers. As shown in FIG. 13, it will be seen that in the heating and fixing apparatus in the present embodiment, the consumed power during the continuous passing of paper is suppressed low as compared with the heating and fixing apparatuses utilizing the other fixing types. It exhibited the rising time (10 sec.) of the fixing apparatus equal to that in the film heating and fixing type, and the average consumed power during the passing of paper exhibited 350 W which was lower by about 150 W than that in the other fixing types.

As described above, it is possible to provide a heating and fixing apparatus which is short in rising time, and low in consumed power even during the passing of paper, as well as excellent in power saving property, by the present invention.

As in the present invention, to provide a heating and fixing apparatus which is short in rising time, and low in consumed power even during the passing of paper, as well as excellent in power saving property, it is preferable in both of the fixing roller and the pressure roller that the bulk density of the porous ceramics layer (adiabatic layer) be 0.2–1.0 g/cm$^2$, and preferably 0.3–0.7 g/cm$^2$. Also, in both of the fixing roller and the pressure roller, it is preferable that the thickness of the adiabatic layer be set to 1–20 mm, and preferably 5–15 mm. Also, in both of the fixing roller and the pressure roller, it is preferable that the elastic layer of silicone rubber be set to a thickness of 0.1–1.5 mm, and preferably 0.3–1.0 mm. Also, in both of the fixing roller and the pressure roller, it is preferable that the thickness of the releasing layer be set to 30–100 μm. Also, when as in the present embodiment, both of the elastic layers of the fixing roller and the pressure roller are silicone rubber, it is preferable to set the width of the conveying nip portion in the direction of movement of the recording material so as to be 1–3 mm.

Second Embodiment

Figure 3:
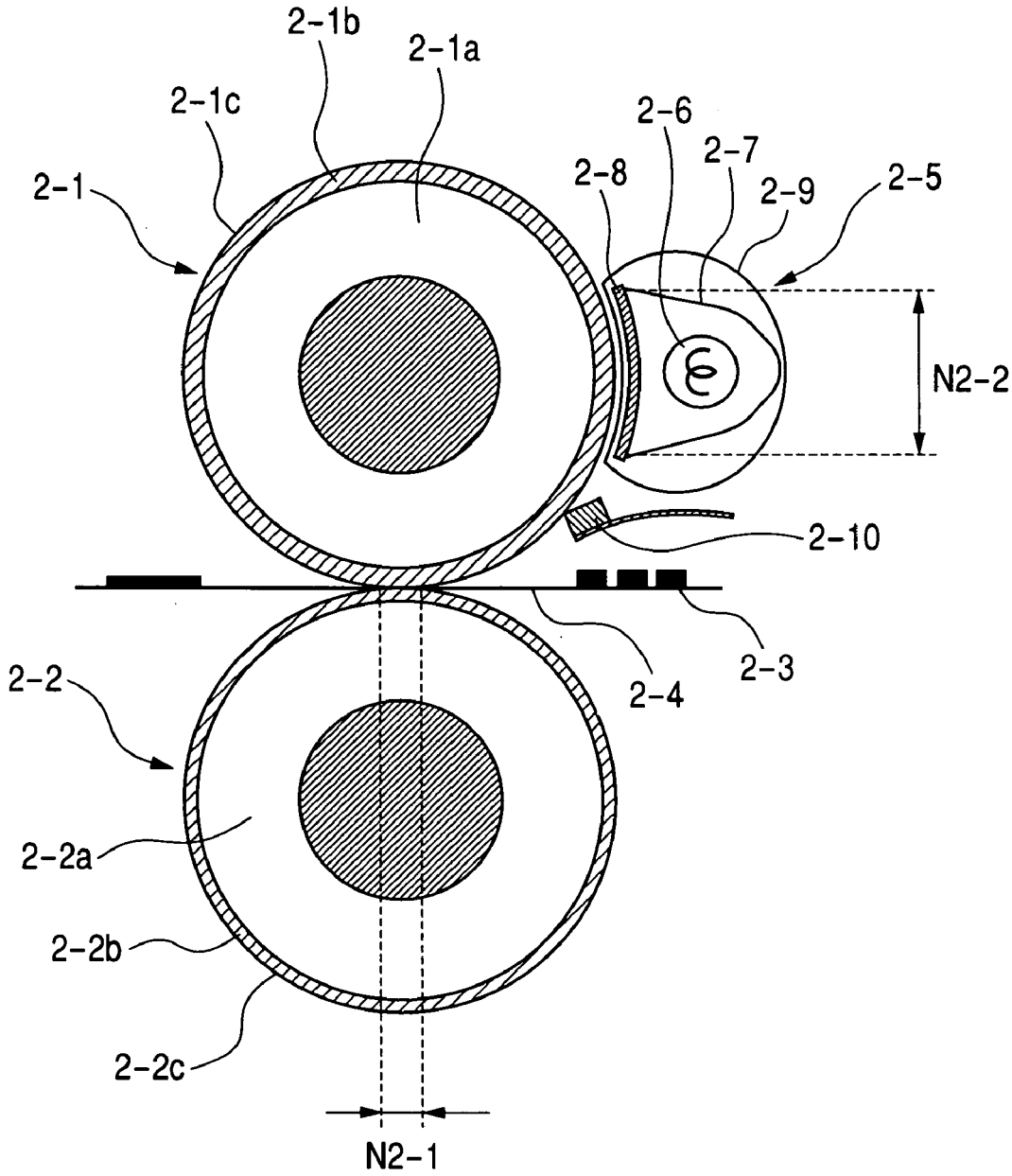
FIG. 3 is a conceptual view (second embodiment) of the image heating and fixing apparatus of the present invention.

In a second embodiment, there is adopted a construction in which a halogen lamp is used as the heat source of the external heating means and the fixing roller is heated through a heat transferring member having a shape along the surface of the fixing roller. FIG. 3 shows a schematic view of a heating and fixing apparatus in the second embodiment. By adopting a construction like that of the second embodiment, the nip width (heating nip width) between the external heating means and the fixing roller is increased, and it becomes possible to heat the fixing roller more efficiently, and shorten the rising time of the fixing apparatus.

The fixing roller 2-1 is of a construction in which a roller base 2-1*a* is porous ceramics having an outer diameter of 40 mm and an inner diameter of 20 mm, and a silicone rubber layer 2-1*b* having a thickness of about 1 mm as an elastic material layer is provided on the outer peripheral surface of the roller base 2-1*a*, and a fluorine resin layer 2-1*c* as a releasing layer is further provided on the outer peripheral surface thereof with a thickness of 30 μm.

A pressure roller 2-2 is of a construction in which a roller base 2-2*a* is porous ceramics having an outer diameter of 40 mm and an inner diameter of 20 mm, and a silicone rubber layer 2-2*b* having a thickness of about 0.3 mm as an elastic material layer is provided on the outer peripheral surface of the roller base 2-2*a*, and a fluorine resin layer 2-2*c* as a releasing layer is further provided on the outer peripheral surface thereof with a thickness of 30 μm.

The porous ceramics used in the present embodiment are burned substances of mixing materials of an inorganic binder and a heat-resistant inorganic material. The internal porosity of a porous ceramic is 30% to 90% preferably 50% to 90%, its bulk density is 0.2–1.0 g/cm$^2$ and preferably 0.3–0.7 g/cm$^2$ and its heat conductivity is 0.1–0.2 W/mK.

The inorganic binder is a material to bind inorganic materials in the process of burning porous ceramics. For example, a glass frit, a colloidal silica, an alumina sol, a silica sol, a silicate of soda, a titania sol, a silicate of lithium or a liquid glass is an example of an inorganic binder.

An alumina, a silica, a zirconia, a titania, a zeolite, a silicon carbide, a potassium titanate or a calcium carbonate is an example of a heat-resistant inorganic material.

The pressure roller 2-2 is disposed under and in parallel to the fixing roller 2-1, and is brought into pressure contact with the latter with total pressure of 50 kg (490N), and forms a nip portion (conveying nip portion) N2-1 of about 3 mm.

The pressure roller 2-2 is driven to rotate in the direction of rotation of the fixing roller 2-1, and when a recording material 2-4 bearing an unfixed toner image 2-3 thereon is introduced into a nip portion N2-1, the pressure roller 2-2 cooperates with the fixing roller 2-1 to nip and convey the recording material 2-4. In the present embodiment, the conveying speed of the recording material 2-4 is 200 mm/sec.

The external heating means 2-5 is means for externally heating the fixing roller 2-1. As the heat source (heater) 2-6, use is made of a radiation heating source such as a halogen lamp or a carbon lamp. In the present embodiment, use is made of a halogen lamp having a diameter of 6 mm, a rated voltage of 120V and consumed power of 700 W. The heat source 2-6 is covered with a reflecting plate 2-7 opening to the fixing roller 2-1 side, and the opening portion of the reflecting plate is of structure in which it is closed by a black curved surface heat transferring plate (heat transferring member) 2-8 having a black surface and formed of a metallic material of high heat conductivity having a shape along the outer peripheral portion of the fixing roller 2-1. As the reflecting plate, use is made of an aluminum plate having its surface adjacent to the halogen lamp subjected to mirror surface working, and as the black curved surface heat transferring plate, use is made of phosphor bronze subjected to black surface working. Also, the external heating means in the present embodiment has film (flexible sleeve) rotated with its inner peripheral surface contacting with the heat transferring member and its outer peripheral surface contacting with the fixing roller. When this external heating means 2-5 is brought into pressure contact with the fixing roller 2-1, the black curved surface heat transferring plate 2-8 having a shape along the fixing roller 2-1 closely contacts with the fixing roller 2-1 with the film 2-9 interposed therebetween to thereby form a nip portion (heating nip portion) N2-2. When the halogen lamp 2-6 is electrically energized, heat is supplied to the nip portion through the black curved surface heat transferring plate 2-8 having a shape along the roller by the radiation heat transferring effect from the halogen lamp 2-6.

The black curved surface heat transferring plate 2-8 contacts with the fixing roller 2-1 with the shape along the fixing roller 2-1, whereby it becomes possible to secure the nip width N2-2 between the black curved surface heat transferring plate 2-8 and the roller widely. In the present second embodiment, the nip width between the fixing roller 2-1 and the black curved surface heat transferring plate 2-8 was about 12 mm.

Temperature detecting means 2-10, and specifically an NTC thermistor abuts against the periphery of the fixing roller 2-1 between the external heating means 2-5 and the conveying nip portion N2-1, and is designed to monitor the surface temperature of the fixing roller 2-1. By this temperature detecting means 2-10, fixing roller temperature detection information is inputted to a control circuit, not shown. The control circuit controls power supply to the halogen lamp 2-6 of the external heating means 2-5 so that the detected temperature of the fixing roller inputted from the temperature detecting means 2-10 may be maintained at a predetermined temperature (fixing temperature). Thereby the surface temperature of the fixing roller 2-1 is controlled to the predetermined temperature. The recording material 2-4 bearing a toner image 2-3 thereon is nipped and conveyed by the nip portion N2-1 to thereby fix the toner image on the recording material.

When in a laboratory kept at a room temperature of 23° C. and humidity of 50%, a process condition was determined so that the density reduction rate in rough paper (Fox River Bond) of basis weight 90 g might become 10%, and power of 700 W was supplied to the halogen lamp and 200 sheets of recording materials were continuously printed at a conveying speed of 200 mm/sec., the time required for the rising of the fixing apparatus was about 7 sec. Also, the average consumed power during the continuous passing of paper was about 350 W.

In the present second embodiment, there is adopted a construction in which the heat transferring plate 2-8 having the shape along the fixing roller 2-1 is disposed in the external heating means 2-5 and the nip portion N2-2 between the heat transferring plate 2-8 and the fixing roller 2-1 is widened. Thereby, it became possible to form a heating nip of 12 mm wide as compared, for example, with the heating nip width of 6 mm in the first embodiment, and it became possible to impart more heat to the fixing roller 2-1 within a short time, and the-rising time of the fixing apparatus could be shortened. A load applied to between the fixing roller 2-1 and the pressure roller 2-2 is 50 kg (490N), and the width of the conveying nip portion N2-1 is 3 mm, and the construction of this portion is equal to that in the first embodiment, and it is possible to effect fixing which is high in pressure dependency, and consumed power during printing equal to that in Embodiment 1-5 was realized.

In the present second embodiment, there is adopted as the external heating means a mechanism in which the supply of heat from the halogen lamp is effected by the curved surface heat transferring plate. The nip with respect to the fixing roller is formed by the curved surface heat transferring plate, whereby a wider nip width could be realized and it became possible to warm the fixing roller efficiently during the rising, and the rising time could be more shortened than in the first embodiment.

Third Embodiment

Figure 4:
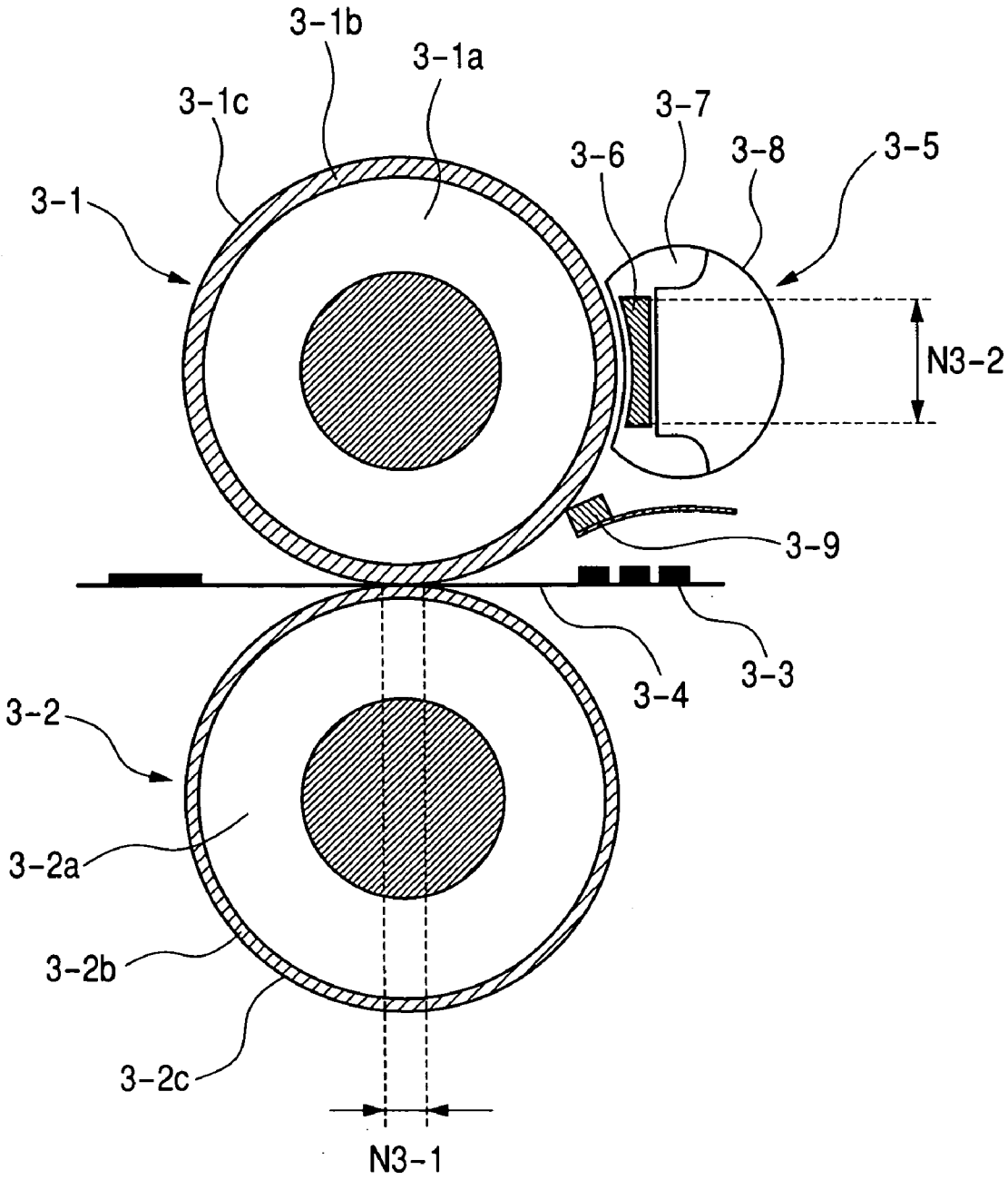
FIG. 4 is a conceptual view (third embodiment) of the image heating and fixing apparatus of the present invention.

FIG. 4 shows a schematic view of a heating and fixing apparatus in a third embodiment. In this third embodiment, porous ceramics 3-6 are used as the heat source (heating member) of external heating means. The porous ceramics 3-6 are usually an insulating substance, but enhance its electrical conductivity by an electrically conductive substance such as carbon being mixed therewith, and become usable as a heat generating member. Also, the porous ceramics are high in hardness and on the other hand, are also high in fragility, and facilitates the working of their shape by shaving or the like.

In the present third embodiment, the surface of the porous ceramics 3-6 used as a heater which contacts with a fixing roller 3-1 was worked to thereby give a curved surface shape along the outer peripheral surface of the fixing roller 3-1. By effecting such working, the close contact property in the nip portion between the external heating means and the fixing roller becomes high and it becomes possible to warm the fixing roller 3-1 more efficiently.

The fixing roller 3-1 is of a construction in which a roller base 3-1*a* is porous ceramics having an outer diameter of 40 mm and an inner diameter of 20 mm, and a silicone rubber layer 3-1*b* having a thickness of about 1 mm as an elastic material layer is provided on the outer peripheral surface of the roller base 3-1*a*, and a fluorine resin layer 3-1*c* as a releasing layer is further provided on the outer peripheral surface thereof with a thickness of 30 μm.

A pressure roller 3-2 is of a construction in which a roller base 3-2*a* is porous ceramics having an outer diameter of 40 mm and an inner diameter of 20 mm, and a silicone rubber layer 3-2*b* having a thickness of about 0.3 mm as an elastic material layer is provided on the outer peripheral surface of the roller base 3-1*a*, and a fluorine resin layer 3-2*c* as a releasing layer is further provided on the outer peripheral surface thereof with a thickness of 30 μm.

The porous ceramics used in the present embodiment are burned substances of mixing materials of an inorganic binder and a heat-resistant inorganic material. The internal porosity of a porous ceramic is 30% to 90% preferably 50% to 90%, its bulk density is 0.2–1.0 g/cm$^2$ and preferably 0.3–0.7 g/cm$^2$ and its heat conductivity is 0.1–0.2 W/mK.

The inorganic binder is a material to bind inorganic materials in the process of burning porous ceramics. For example, a glass frit, a colloidal silica, an alumina sol, a silica sol, a silicate of soda, a titania sol, a silicate of lithium or a liquid glass is an example of an inorganic binder.

An alumina, a silica, a zirconia, a titania, a zeolite, a silicon carbide, a potassium titanate or a calcium carbonate is an example of a heat-resistant inorganic material.

The pressure roller 3-2 is disposed under and in parallel to the fixing roller 3-1, and is brought into pressure contact with the latter with total pressure of 50 kg (490N) to thereby form a nip portion N3-1 of about 3 mm.

The pressure roller 3-2 is driven to rotate in the direction of rotation of the fixing roller 3-1, and when a recording material 3-4 bearing an unfixed toner image 3-3 thereon is introduced into the nip portion N3-1, the pressure roller 3-2 cooperates with the fixing roller 3-1 to nip and convey the recording material 3-4. In the present embodiment, the conveying speed of the recording material 3-4 is 200 mm/sec.

External heating means 3-5 is means for externally heating the fixing roller 3-1. A heating member 3-6 is porous ceramics enhanced in electrical conductivity by carbon being mixed therewith, and capable of generating heat by electrical energization. In the present third embodiment, use is made of porous ceramics having had resistance adjusted to 17.1 Ω, and of which the surface contacting with the fixing roller 3-1 was worked by shaving and was given a curved surface shape having a radius of curvature of 40 mm.

The external heating means 3-5 comprises porous ceramics 3-6 as a heating member, a stay 3-7 which is a supporting member adiabatically supporting this heating member, and film (flexible sleeve) 3-8 of a thin-walled cylindrical shape formed of a heat-resistant resin material rotated with the inner peripheral surface thereof contacting with the porous ceramics 3-6 and the outer peripheral surface thereof contacting with the fixing roller.

This external heating means 3-5 is arranged so that the curved surface side of the heating member 3-6 may be parallel to the fixing roller 3-1, and is brought into pressure contact with the fixing roller 3-1 with total pressure of 10 kg (98N). At this time, a heating nip portion N3-2 is formed by the fixing roller 3-1 and the heating member 3-6. The width of the nip portion N3-2 at this time was about 10 mm.

The fixing roller 3-1 is rotatively driven and along therewith, the film 3-8 of the external heating means 3-5 becomes rotated while frictionally sliding with respect to the heating member 3-6 and the stay 3-7. Thereafter, the heating member 3-6 is electrically energized and generates heat, whereby the surface of the fixing roller 3-1 is heated.

Temperature detecting means 3-9, and specifically an NTC thermistor abuts against the periphery of the fixing roller 3-1 between the external heating means 3-5 and the conveying nip portion N3-1, and is designed to monitor the surface temperature of the fixing roller 3-1.

By this temperature detecting means 3-9, fixing roller temperature detection information is inputted to a control circuit, not shown. The control circuit controls the power supply to the porous ceramics 3-6 as the heating member of the external heating means 3-5 so that the detected temperature of the fixing roller inputted from the temperature detecting means 3-9 may be maintained at a predetermined temperature (fixing temperature). Thereby, the surface temperature of the fixing roller 3-1 is controlled to the predetermined temperature. The recording material 3-4 bearing the toner image 3-3 thereon is nipped and conveyed by the nip portion N3-1 to thereby fix the toner image on the recording material 3-4.

When in a laboratory kept at a room temperature of 23° C. and humidity of 50%, a process condition was determined so that the density reduction rate in rough paper (Fox River Bond) of basis weight 90 g might be 10%, and power of 700 W was supplied to the heating member 3-6 and 200 sheets of recording materials were continuously printed at a conveying speed of 200 mm/sec., the time required for the rising of the fixing apparatus was about 8 sec. Also, the average consumed power during the continuous passing of paper was about 350 W.

In the present third embodiment, there is adopted a construction in which the heating member 3-6 having a shape along the outer peripheral surface of the fixing roller 3-1 is disposed in the external heating means 3-5, and the heating nip portion N3-2 between the heating member 3-6 and the fixing roller 3-1 is widened. Thereby, it became possible to form a nip portion of 10 mm wide as compared, for example, with the heating nip width of 6 mm in the first embodiment, and it became possible to impart more heat to the fixing roller 3-1 within a short time, and the rising time of the fixing apparatus could be shortened. In the first embodiment, the nip between the external heating means and the fixing roller was 6 mm and the rising time was 10 sec., and in the second embodiment, the nip between the external heating means and the fixing roller was 12 mm and the rising time was 7 sec. In the present third embodiment, the nip between the external heating means and the fixing roller was 10 mm and the rising time was 8 sec.

As the nip width between the external heating means and the fixing roller increased in the order of the first embodiment, the third embodiment and the second embodiment, the rising time of the fixing apparatus was shortened, and the nip width between the external heating means and the fixing roller and the rising time of the fixing apparatus exhibited a good correlation.

Also, the load applied to between the fixing roller 3-1 and the pressure roller 3-2 was 50 kg (490N) and the width of the conveying nip portion N3-1 was 3 mm, and the construction of this portion is equal to that in the first embodiment, and it was possible to effect fixing high in pressure dependency, and consumed power during the printing equal to that in Embodiment 1-5 was realized.

Again in the present third embodiment, as the external heating mechanism, there is adopted a mechanism in which the supply of heat is effected by the heating member having the shape along the fixing roller. By the nip with respect to the fixing roller being formed by the curved surface heating member, a wider heating nip width could be realized, and it became possible to warm the fixing roller efficiently in case of rising, and the rising time could be shortened.

In the first to third embodiments, with regard also to the pressure rollers 1-2, 2-2 and 3-3 it is also possible to adopt an apparatus construction in which these are heated to a predetermined temperature by suitable external heating means 1-8, 2-5 and 3-5.

Fourth Embodiment

Figure 5:
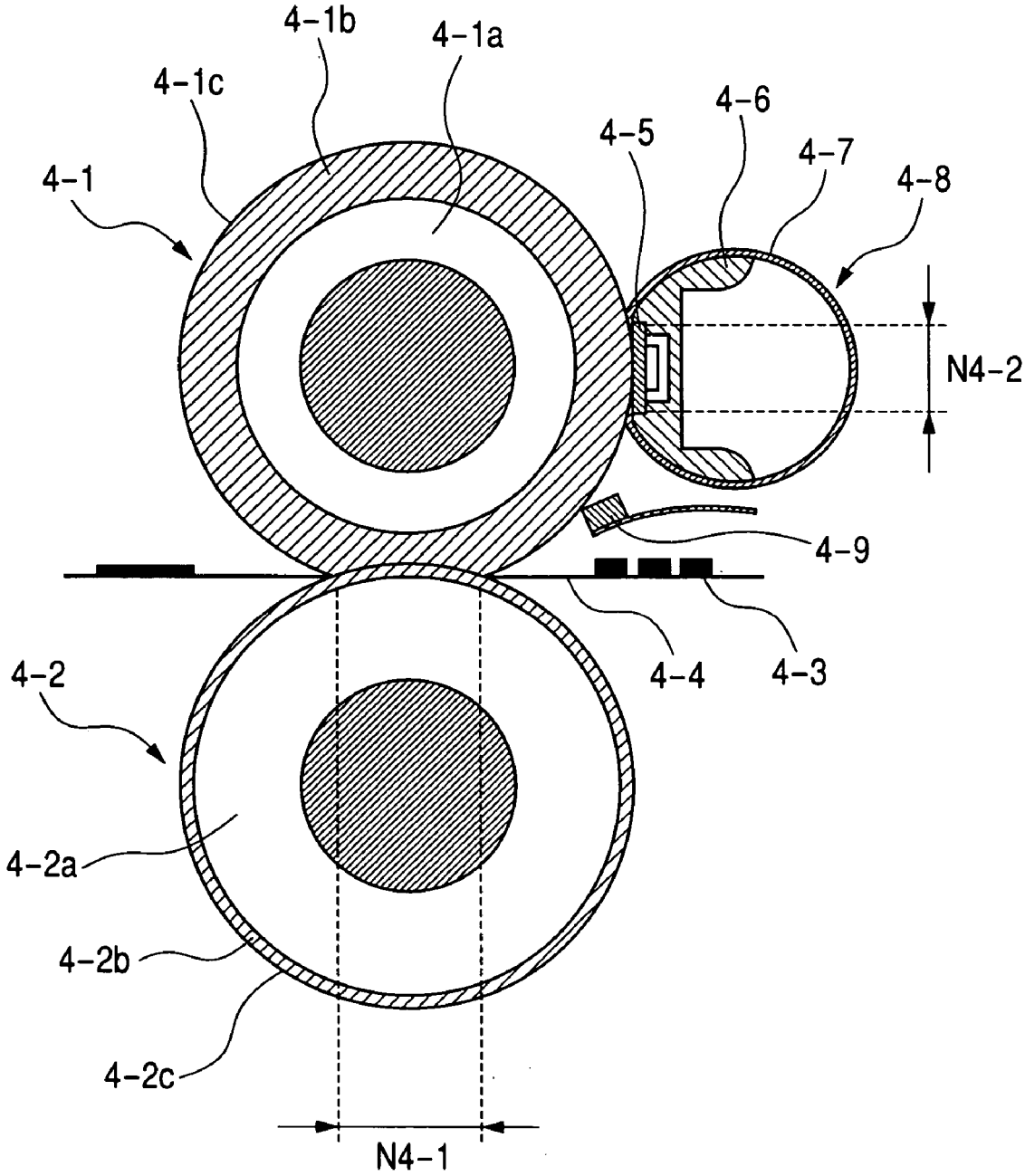
FIG. 5 is a conceptual view (fourth embodiment) of the image heating and fixing apparatus of the present invention.
Figure 6:
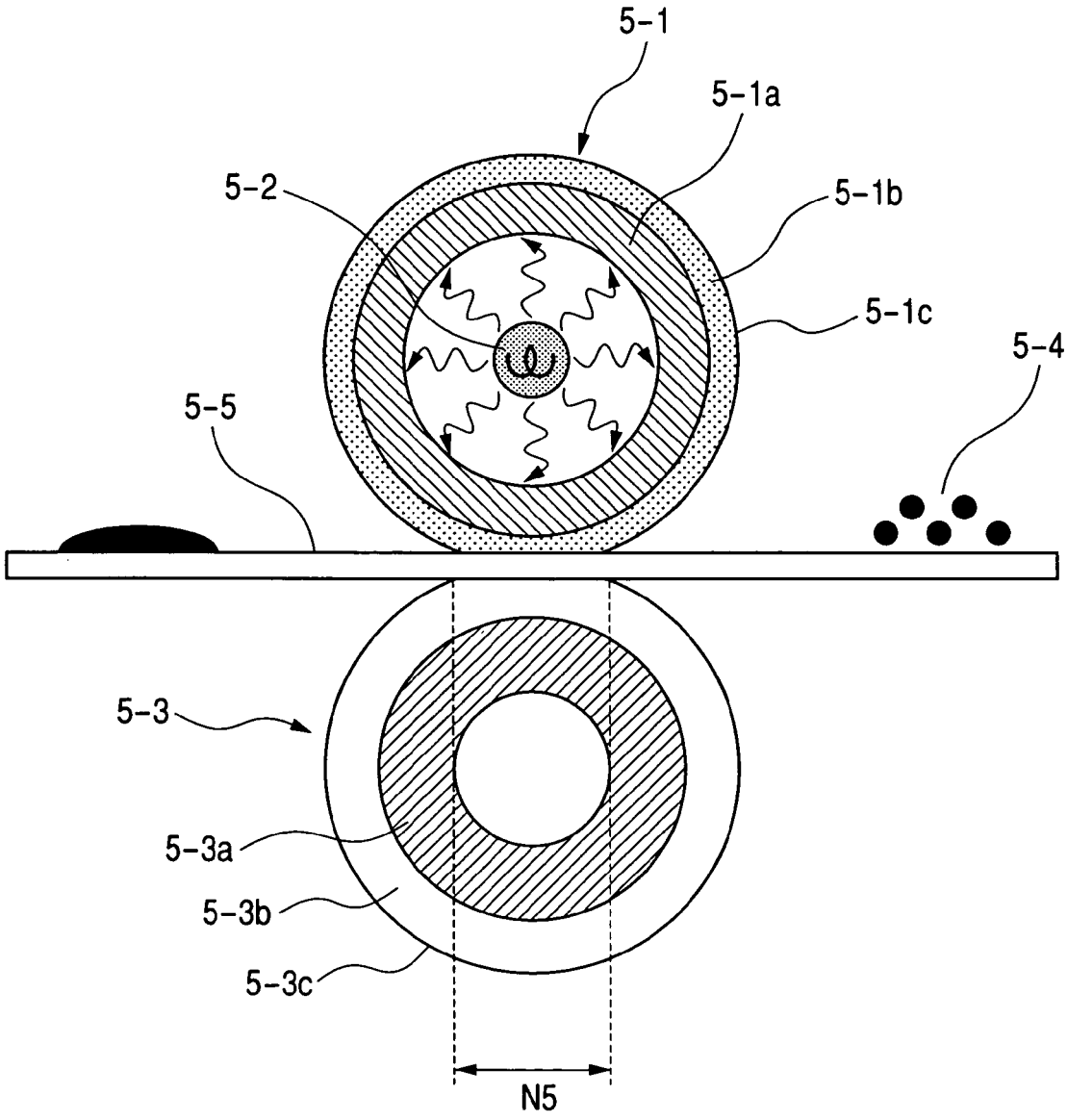
FIG. 6 is a conceptual view of an image heating apparatus using a conventional heating roller fixing process.
Figure 7:
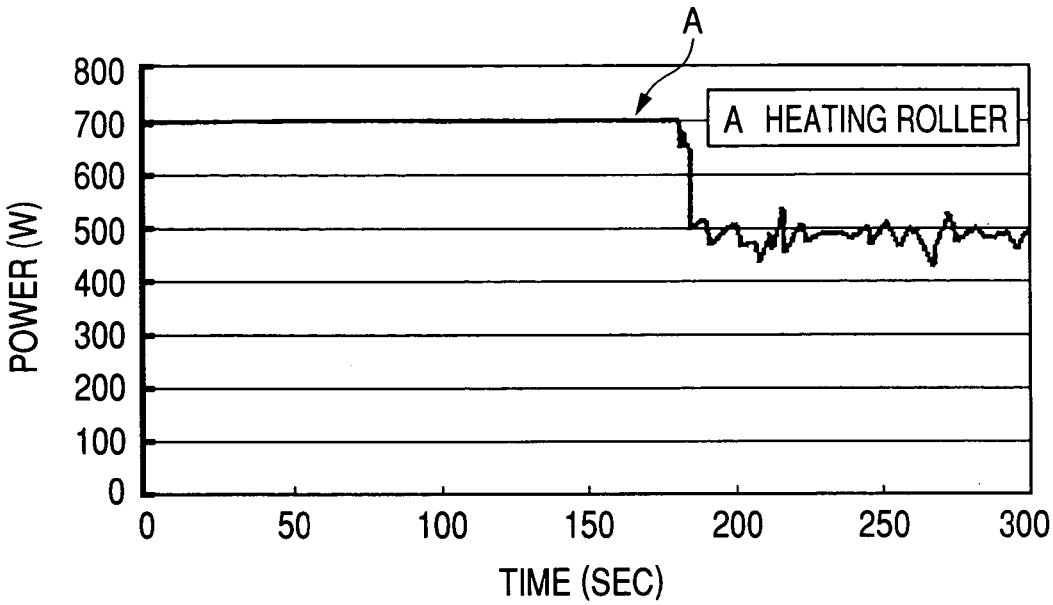
FIG. 7 is a graph of a power waveform in the conventional heating roller fixing type.
Figure 8:
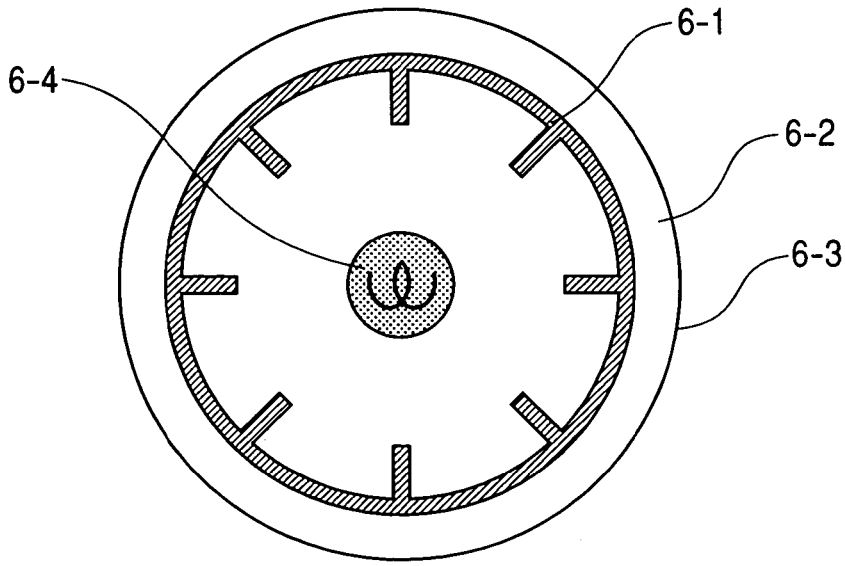
FIG. 8 is a schematic view of a conventional fixing roller having ribs horizontal with respect to the axis of the roller provided on the inner surface thereof.
Figure 9:
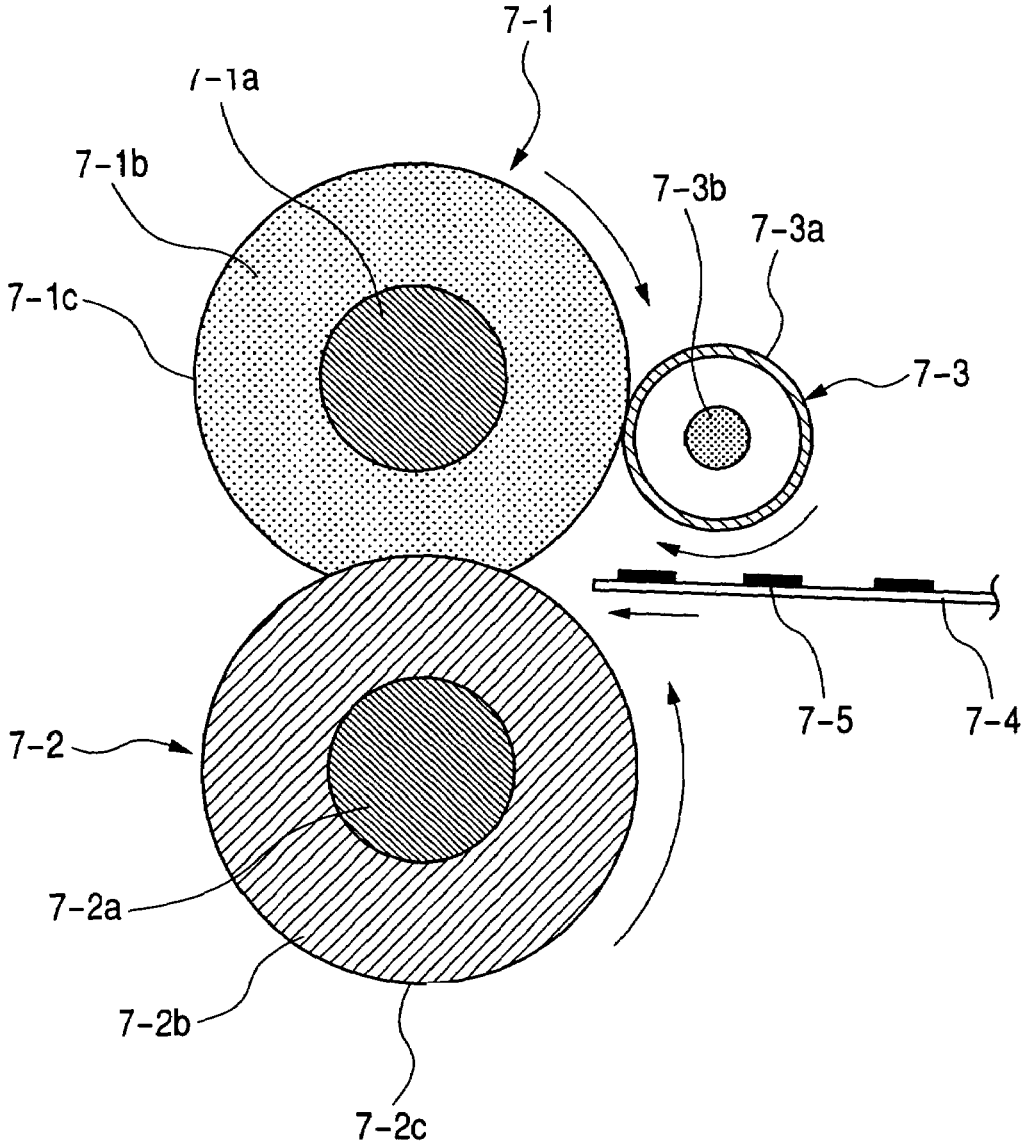
FIG. 9 is a schematic view of a heating roller fixing type provided with an external heating apparatus.
Figure 10:
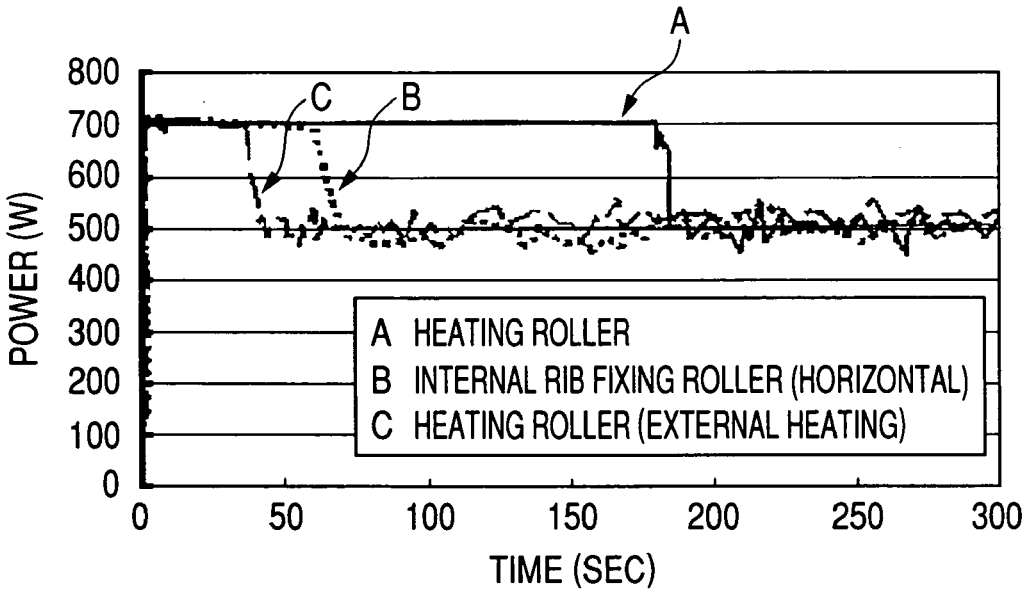
FIG. 10 is a graph of consumed power waveforms in the conventional heating roller fixing type, a heating roller type using a thin-walled fixing roller, and a heating roller fixing type provided with an external heating apparatus.
Figure 11:
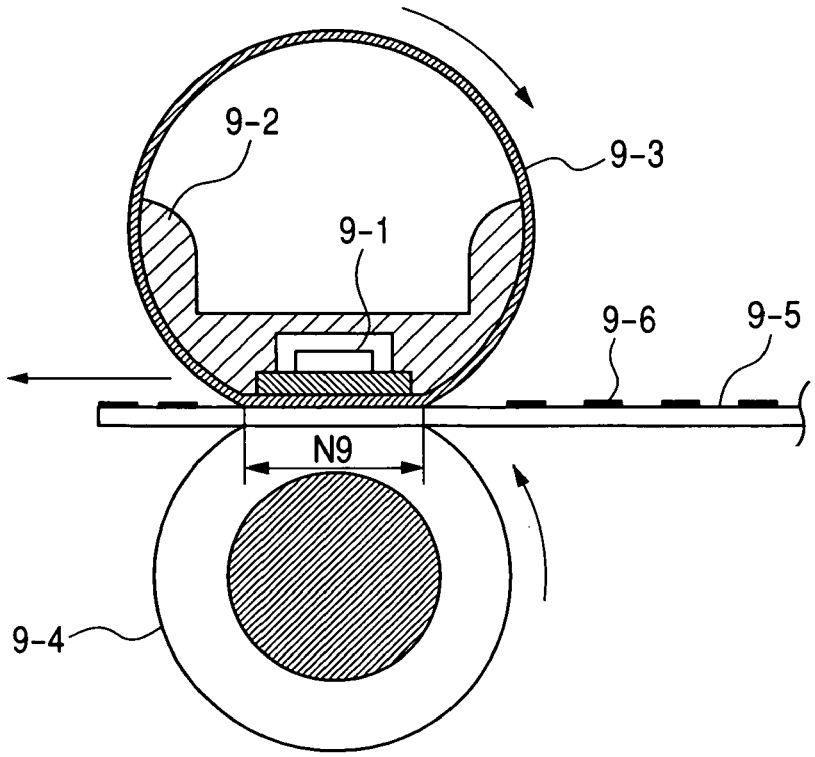
FIG. 11 is a schematic view of a fixing apparatus utilizing a film heating type which is a conventional example.

In the first to third embodiments, the elastic layer of the fixing roller was silicone rubber. In this fourth embodiment, there is adopted a construction in which foamed silicone rubber is used as the elastic layer of the fixing roller. FIG. 5 shows a schematic view of a heating and fixing apparatus in the fourth embodiment. In the present embodiment, the elastic layer of the fixing roller is formed of foamed silicone rubber, whereby it becomes easier for the fixing roller to receive heat from the external heating means by the heating nip portion than in the first to third embodiments, and the heat accumulating performance by the elastic layer of the fixing roller is improved and therefore, it becomes possible to construct a more efficient fixing apparatus.

The fixing roller 4-1 is of a construction in which a roller base 4-1*a* is porous ceramics having an outer diameter of 40 mm and an inner diameter of 20 mm, and a foamed silicone rubber layer 4-1*b* having a thickness of about 2 mm as an elastic material layer is provided on the outer peripheral surface of the roller base 4-1*a*, and a fluorine resin layer 4-1*c* as a releasing layer is further provided on the outer peripheral surface thereof with a thickness of 30 μm. In the case that an expandable silicone rubber is used as an elastic layer of a fixing roller like the fourth embodiment, the thickness of an elastic layer may be set within a range of 1.0 to 5.0 mm, preferably 1.5 to 3.5 mm.

A pressure roller 4-2 is of a construction in which a roller base 4-2*a* is porous ceramics having an outer diameter of 40 mm and an inner diameter of 20 mm, and a silicone rubber layer 4-2*b* having a thickness of about 0.3 mm as an elastic material layer is provided on the outer peripheral surface of the roller base 4-2*a*, and a fluorine resin layer 4-2*c* as a releasing layer is further provided on the outer peripheral surface thereof with a thickness of 30 μm.

Since a pressure roller is made of a solid silicone rubber in the same manner as the embodiments 1 to 3, the thickness of an elastic layer may be set within a range of 0.1 to 1.5 mm, preferably 0.3 to 1.0 mm.

The porous ceramics used in the present embodiment are burned substances of mixing materials of an inorganic binder and a heat-resistant inorganic material. The internal porosity of a porous ceramic is 30% to 90% preferably 50% to 90%, its bulk density is 0.2–1.0 g/cm$^2$ and preferably 0.3–0.7 g/cm$^2$ and its heat conductivity is 0.1–0.2 W/mK.

The inorganic binder is a material to bind inorganic materials in the process of burning porous ceramics. For example, a glass frit, a colloidal silica, an alumina sol, a silica sol, a silicate of soda, a titania sol, a silicate of lithium or a liquid glass is an example of an inorganic binder.

An alumina, a silica, a zirconia, a titania, a zeolite, a silicon carbide, a potassium titanate or a calcium carbonate is an example of a heat-resistant inorganic material.

The pressure roller 4-2 is disposed under and in parallel to the fixing roller 4-1, and is brought into pressure contact with the latter with total pressure of 30 kg (294N) to thereby form a conveying nip portion N4-1 of about 6 mm.

The pressure roller 4-2 is driven to rotate in the direction of rotation of the fixing roller 4-1, and when a recording material 4-4 bearing an unfixed toner image 4-3 thereon is introduced into the nip portion N4-1, the pressure roller 4-2 cooperates with the fixing roller 4-1 to nip and convey the recording material 4-4. In the present embodiment, the conveying speed of the recording material is 200 mm/sec.

In the present embodiment, external heating means 4-8 is the same as that in the first embodiment. This external heating means 4-8 is arranged so that the heater 4-5 side thereof may be parallel to the fixing roller 4-1, and is brought into pressure contact with the fixing roller 4-1 with total pressure of 10 kg (98N). At this time, a heating nip portion N4-2 is formed by the fixing roller 4-1 and the heater 4-5. The width of the heating nip portion N4-2 at this time was about 8 mm. The fixing roller 4-1 is rotatively driven and along therewith, the film 4-7 of the external heating means 4-8 becomes driven to rotate while frictionally sliding with respect to the heater 4-5 and a stay 4-6. Thereafter, the heater 4-5 is electrically energized and generates heat, whereby the surface of the fixing roller 4-1 is heated. Temperature detecting means 4-9, and specifically an NTC thermistor abuts against the periphery of the fixing roller 4-1 between the external heating means 4-8 and the conveying nip portion N4-1, and is designed to monitor the surface temperature of the fixing roller 4-1. By this temperature detecting means 4-9, fixing roller temperature detection information is inputted to a control circuit, not shown. The control circuit controls the power supply to the heater 4-5 of the external heating means 1-8 so that the detected temperature of the fixing roller inputted from the temperature detecting means 4-9 may be maintained at a predetermined temperature (fixing temperature). Thereby the surface temperature of the fixing roller 4-1 is controlled to the predetermined temperature.

The recording material 4-4 bearing the toner image 4-3 thereon is nipped and conveyed by the nip portion N4-1 to thereby fix the toner image on the recording material 4-4.

When in a laboratory kept at a room temperature of 23° C. and humidity of 50%, a process condition was determined so that the density reduction rate in rough paper (Fox River Bond) of basis weight 90 g might be 10%, and power of 700 W was supplied to the heater and 200 sheets of recording materials were continuously printed at a conveying speed of 200 mm/sec., the time required for the rising of the fixing apparatus was about 6.8 sec. Also, the average consumed power during the passing of paper was about 350 W.

In the present fourth embodiment, the foamed silicone rubber layer 4-1*b* is used as the elastic layer of the fixing roller 4-1. The foamed silicone rubber layer has the property that when it is crushed and the internal pores thereof are crushed, the exchange of heat with the outside becomes easy, and when it is not crushed but the pores are of a normal shape, it becomes difficult for the exchange of heat with the outside to occur. In the heating nip portion with respect to the external heating apparatus, the silicone rubber layer is compressed by pressure and the internal pores are crushed and therefore, it is easy to receive heat from the external heating apparatus. Also, in the heating nip portion and the conveying nip portion, the pores of the foamed silicone rubber layer are crushed by pressure, but in the other portions, the foamed silicone rubber is restored to its original shape by its force of restitution and the pores are also restored to their original shape. Accordingly, it is difficult due to the presence of the internal pores for the heat received from the external heating means to radiate, and a heat accumulating effect heightens. Therefore, heat transfer from the external heating means to the fixing roller becomes quick and also, it is difficult for the heat transferred from the external heating means to the fixing roller to radiate from the fixing roller until it comes to the conveying nip portion. Therefore, the quick rising of the fixing apparatus is possible, and the time required for the rising of the fixing apparatus was shortest of all embodiments.

In the present fourth embodiment, use is made of foamed silicone rubber having a thickness of 2 mm and therefore, the conveying nip N4-1 with respect to the pressure roller 4-2 is large as compared with that in the first to third embodiments. Accordingly, when the recording material is not nipped by the conveying nip portion, the amount of heat transferred from the fixing roller to the pressure roller becomes greater than in the first to third embodiments and therefore, considering this point only, the present embodiment is more disadvantageous for the shortening of the rising time of the fixing apparatus than the first to third embodiments. The present embodiment, however, is more excellent in the heat keeping performance of the other areas than the heating nip portion and the conveying nip portion in the circumferential direction of the fixing roller than the first to third embodiments and therefore, not only it becomes difficult for the heat transferred from the external heating means to the fixing roller to radiate from the fixing roller until it comes to the conveying nip portion, but the amount of radiant heat until the area of the fixing roller which has passed the conveying nip portion returns to the heating nip portion is also very small. Accordingly, in spite of the presence of the above-noted disadvantage, the rising time of the fixing apparatus becomes very short. When the recording material is passed through the conveying nip portion, the radiation effect from the fixing roller in the conveying nip portion is high and therefore, the heating efficiency to the toner on the recording material is also excellent.

The foamed silicone rubber is low in strength as compared with the silicone rubber as in the first to third embodiments which is not foamed and therefore, low pressure as compared with the first to third embodiments is applied. Also, when as in the present embodiment, the elastic layer of the fixing roller is foamed silicone rubber and the elastic layer of the pressure roller is non-foamed silicone rubber, it is preferable that the conveying nip width be set to 3-7 mm.

As described above, in the present fourth embodiment, in addition to the fixing type high in pressure dependency described in the first to third embodiments, there is further adopted a fixing type having added thereto the heat accumulating (heat keeping) effect by the presence of the foamed silicone rubber and the heat transfer dependency to the toner image.

By the above-described construction, the power saving during printing also becomes possible.

In the present fourth embodiment, foamed silicone rubber is used as the elastic layer of the fixing roller. Thereby, in addition to the effect of the pressure force of the conveying nip portion by the porous ceramics layers of the fixing roller and the pressure roller, the heat receiving performance in the heating nip portion between the external heating means and the fixing roller, the heat keeping performance of the other areas of the fixing roller than the heating nip portion area and the conveying nip portion area, and the heat discharging performance in the conveying nip portion between the fixing roller and the pressure roller are improved and therefore, it has become possible to effect efficient fixing which is small in consumed power.

The present invention is not restricted to the above-described embodiments, but covers modification within the technical idea of the present invention.

This application claims priority from Japanese Patent Application No. 2004-024340 filed Jan. 30, 2004 and Japanese Patent Application No. 2005-005372 filed Jan. 12, 2005 which are hereby incorporated by reference herein.

What is claimed is:

1. An image heating apparatus for heating an image formed on a recording material, comprising:

a first roller;

a second roller which forms a conveying nip portion for passing the recording material therethrough, with said first roller; and heating means for heating said first roller from an outer peripheral surface side thereof, wherein each of said first roller and said second roller has an adiabatic layer formed of a porous ceramics material, and an elastic layer disposed outside said adiabatic layer, and wherein said adiabatic layer is formed by sintered porous ceramics having an inorganic binder and a heat-resistant inorganic material as main components, and having integral porosity of 30 to 90% and bulk density of 0.2 to 1.0 g/cm$^2$.

2. An image heating apparatus according to claim 1, wherein the bulk density of said porous ceramics is 0.3 to 0.7 g/cm$^2$.

3. An image heating apparatus according to claim 1, wherein a thickness of said adiabatic layer is 1 to 20 mm.

4. An image heating apparatus according to claim 3, wherein the thickness of said adiabatic layer is 5 to 15 mm.

5. An image heating apparatus according to claim 1, wherein said elastic layer is a silicone rubber layer having a thickness of 0.1 to 1.5 mm.

6. An image heating apparatus according to claim 5, wherein said elastic layer is a silicone rubber layer having a thickness of 0.3 to 1.0 mm.

7. An image heating apparatus according to claim 1, wherein said elastic layer of said first roller is a foamed silicone rubber layer having a thickness of 0.1 to 5.0 mm.

8. An image heating apparatus according to claim 7, wherein said elastic layer of said first roller is a foamed silicone rubber layer having a thickness of 1.5 to 3.5 mm.

9. An image heating apparatus according to claim 1, wherein each of said first roller and said second roller further has a releasing layer having a thickness of 30 to 100 mm outside said elastic layer.

10. An image heating apparatus according to claim 1, wherein said elastic layer of each of said first roller and said second roller is a silicone rubber layer, and in a direction of movement of said recording material, a width of said conveying nip portion is 1 to 3 mm.

11. An image heating apparatus according to claim 1, wherein said elastic layer of said first roller is a foamed silicone rubber layer, said elastic layer of said second roller is a silicone rubber layer, and in the direction of movement of said recording material, the width of said conveying nip portion is 3 to 7 mm.

12. An image heating apparatus according to claim 1, wherein said heating means has a heater, a supporting member for supporting said heater, and a flexible sleeve rotated with an inner peripheral surface thereof contacting with said heater and an outer peripheral surface thereof contacting with said first roller, and said first roller is heated by said heater through said flexible sleeve.

13. An image heating apparatus according to claim 12, wherein a surface of contact of said heater with said flexible sleeve is of a shape along the outer peripheral surface of said first roller.

14. An image heating apparatus according to claim 13, wherein said heater is porous ceramics containing an electrically conducting substance.

15. An image heating apparatus according to claim 1, wherein said heating means has a heater and a heat transferring member for transferring heat of said heater to said first roller, and said heat transferring member has a surface of a shape along the outer peripheral surface of said first roller.

16. An image heating apparatus according to claim 15, wherein said heating means further has a flexible sleeve rotated with the inner peripheral surface thereof contacting with said heat transferring member and the outer peripheral surface thereof contacting with said first roller.

* * * * *

UNITED STATES PATENT AND TRADEMARK OFFICE

CERTIFICATE OF CORRECTION

PATENT NO. : 7,200,355 B2
APPLICATION NO. : 11/042142
DATED : April 3, 2007
INVENTOR(S) : Koji Uchiyama et al.

It is certified that error appears in the above-identified patent and that said Letters Patent is hereby corrected as shown below:

COLUMN 1
Line 27, “he” should read --the--.

COLUMN 2
Line 22, “becomes low” should read --becomes as low--.

COLUMN 3
Line 63, “the” should be deleted.

COLUMN 4
Line 20, “dot” should read --dot representing--.
Line 22, “after” should read --after being--.

COLUMN 8
Line 43, “after” should read --after being--.

COLUMN 9
Line 58, “$g/cm^2$” should read --$g/cm^3$--.
Line 59, “$g/cm^2$” should read --$g/cm^3$--.

COLUMN 10
Line 21, “(flexible” should read --flexible--.
Line 38, “on” should be deleted.
Line 52, “to” should be deleted.

COLUMN 11
Line 17, “changed.” should read --change.--.
Line 42, “suppressed low,” should read --suppressed,--.

COLUMN 13
Line 4, “suppressed low,” should read --suppressed,--.
Line 8, “low” should be deleted.
Line 26, “$g/cm^2$,” should read --$g/cm^3$,--; and “$g/cm^2$,” should read --$g/cm^3$,--.

COLUMN 14
Line 8, “$g/cm^2$” should read --$g/cm^3$--.
Line 9, “$g/cm^2$” should read --$g/cm^3$--.

UNITED STATES PATENT AND TRADEMARK OFFICE

CERTIFICATE OF CORRECTION

PATENT NO. : 7,200,355 B2
APPLICATION NO. : 11/042142
DATED : April 3, 2007
INVENTOR(S) : Koji Uchiyama et al.

It is certified that error appears in the above-identified patent and that said Letters Patent is hereby corrected as shown below:

COLUMN 15
Line 64, “enhance” should be deleted.
Line 65, “by” should read --was enhanced by--.

COLUMN 16
Line 2, “and” should read --which--.
Line 32, “g/cm$^2$” should read --g/cm$^3$--.
Line 33, “g/cm$^2$” should read --g/cm$^3$--.

COLUMN 18
Line 4, “to” should be deleted.

COLUMN 19
Line 1, “g/cm$^2$” should read --g/cm$^3$--.
Line 2, “g/cm$^2$” should read --g/cm$^3$--.

COLUMN 20
Line 37, “it becomes” should read --does it become--.

COLUMN 21
Line 38, “g/cm$^2$” should read --g/cm$^3$--.
Line 41, “g/cm$^2$” should read --g/cm$^3$--.

Signed and Sealed this

Sixteenth Day of September, 2008

JON W. DUDAS
*Director of the United States Patent and Trademark Office*